US010926151B2

(12) United States Patent
Dunahay

(10) Patent No.: US 10,926,151 B2
(45) Date of Patent: Feb. 23, 2021

(54) WEIGHT RACK AND SHELF

(71) Applicant: Coulter Ventures, LLC, Columbus, OH (US)

(72) Inventor: Nash Dunahay, Gahanna, OH (US)

(73) Assignee: Coulter Ventures, LLC., Columbus, OH (US)

( * ) Notice: Subject to any disclaimer, the term of this patent is extended or adjusted under 35 U.S.C. 154(b) by 0 days.

(21) Appl. No.: 16/291,849

(22) Filed: Mar. 4, 2019

(65) Prior Publication Data

US 2019/0269992 A1 Sep. 5, 2019

Related U.S. Application Data

(60) Provisional application No. 62/637,843, filed on Mar. 2, 2018.

(51) Int. Cl.

| | |
|---|---|
| ***A63B 71/00*** | (2006.01) |
| ***A47B 81/00*** | (2006.01) |
| ***A47B 47/02*** | (2006.01) |
| ***A47B 57/44*** | (2006.01) |
| ***A47B 57/34*** | (2006.01) |

(52) U.S. Cl.

CPC ..... *A63B 71/0036* (2013.01); *A47B 47/024* (2013.01); *A47B 57/34* (2013.01); *A47B 57/44* (2013.01); *A47B 81/00* (2013.01)

(58) Field of Classification Search

CPC ..... A63B 71/0036; A63B 21/0726; A47B 47/024; A47B 81/00

See application file for complete search history.

(56) References Cited

U.S. PATENT DOCUMENTS 1,438,729 A * 12/1922 Vance ..... A47F 7/04 211/23
3,085,693 A * 4/1963 Shell ..... A47B 57/425 211/134
3,184,068 A * 5/1965 Wende ..... A47F 7/04 211/23

(Continued)

OTHER PUBLICATIONS

Product listing for Rogue Monster Mass Storage from https://web.archive.org/web/20170703212533/http://www.roguefitness.com:80/monster-mass-storage, dated Jul. 3, 2017.

(Continued)

*Primary Examiner* — Stanton L Krycinski
(74) *Attorney, Agent, or Firm* — Banner & Witcoff, Ltd.

(57) ABSTRACT

A shelf is configured for use with a weight rack including first and second vertical members extending generally parallel to each other and positioned in spaced relation to each other. The shelf supports one or more free weights and has first and second opposed ends and front and rear sides extending between the ends, where the first end of the shelf is connected to the first vertical member and the second end of the shelf is connected to the second vertical member, such that the first and second vertical members support the entire weight of the shelf. The shelf may include a rotation limiting structure to limit rotation of the shelf with respect to the vertical members. A weight rack may be outfitted with one or more such shelves, and in one configuration, the weight rack may include a number (N) of adjacent shelf stacks supported by number (N+1) of vertical members.

22 Claims, 18 Drawing Sheets

(56) References Cited

U.S. PATENT DOCUMENTS 3,313,424 A * 4/1967 Gingher ..... A47G 25/0692 211/113
3,348,698 A * 10/1967 McConnell ..... A47F 7/04 211/24
3,556,306 A * 1/1971 Shell ..... A47B 96/021 211/90.02
3,557,966 A * 1/1971 Skubic ..... A47B 81/007 211/24
3,921,539 A * 11/1975 Berger ..... A47F 5/12 108/8
4,765,493 A 8/1988 Kinney
5,097,969 A 3/1992 Maxworthy
D330,090 S 10/1992 Walter et al.
5,253,837 A * 10/1993 Loux ..... A47B 96/00 108/152
D345,480 S 3/1994 Sandegren
5,626,084 A 5/1997 Kelly et al.
D385,140 S 10/1997 Whitehead et al.
5,690,415 A 11/1997 Krehl
6,014,078 A * 1/2000 Rojas ..... A63B 21/072 340/568.6
6,123,033 A * 9/2000 Polley ..... A47F 5/0018 108/107
6,209,731 B1 4/2001 Spamer et al.
D490,697 S 6/2004 Runnalls
D521,286 S 5/2006 Colmenares
D563,135 S 3/2008 Lien
D565,673 S * 4/2008 Lien ..... D21/686
D575,722 S 8/2008 Beauchamp et al.
D577,234 S * 9/2008 Webber ..... D6/552
7,494,019 B2 * 2/2009 Kessell ..... A47B 57/06 108/108
D599,580 S 9/2009 Whittier et al.
D628,299 S 11/2010 Held
D652,932 S 1/2012 Petteway
8,424,466 B2 4/2013 Botkin
D695,555 S 12/2013 Wind
D702,541 S 4/2014 Mansor
8,720,704 B2 * 5/2014 Gupta ..... A47B 57/38 211/74
D707,067 S 6/2014 Basarich et al.
D709,107 S 7/2014 Kim et al.
D709,533 S 7/2014 Park et al.
D714,131 S 9/2014 Mansor
8,900,074 B1 * 12/2014 Johnson ..... A63B 69/205 473/422
D722,622 S 2/2015 Kim et al.
D724,119 S 3/2015 Kim et al.
D724,631 S 3/2015 Kim et al.
D743,454 S 11/2015 Yeo et al.
D776,956 S 1/2017 Ma
9,541,245 B2 1/2017 Floersch et al.
D789,718 S 6/2017 Gokhale et al.
9,775,447 B2 10/2017 Wiemer et al.
D801,734 S 11/2017 Turner et al.
D834,736 S 11/2018 Liu
10,130,196 B2 11/2018 Burns
D845,045 S 4/2019 Dunahay
D847,535 S 5/2019 Goodman et al.
D862,136 S 10/2019 Dunahay
2005/0161416 A1 * 7/2005 Anderson ..... A47B 46/00 211/85.7
2005/0233872 A1 * 10/2005 Harms ..... A63B 71/0036 482/104
2007/0049472 A1 * 3/2007 Hummer, Jr. ..... A63B 71/0036 482/104
2007/0099773 A1 * 5/2007 Hummer, Jr. ..... A63B 21/078 482/104
2007/0227989 A1 * 10/2007 Schneider ..... A47B 47/00 211/85.7
2008/0156752 A1 7/2008 Bryson et al.
2008/0203040 A1 * 8/2008 Kologe ..... A47F 5/0838 211/103
2008/0302748 A1 12/2008 Tsai
2009/0211996 A1 * 8/2009 Webber ..... A47F 7/0028 211/85.7
2012/0085721 A1 * 4/2012 Michael J. ..... A47F 5/0853 211/103
2017/0149269 A1 * 5/2017 Rojas ..... H02J 7/025
2017/0266503 A1 * 9/2017 Watterson ..... A63B 21/0726
2018/0290042 A1 * 10/2018 Vester ..... A63B 71/0036
2019/0175979 A1 * 6/2019 Towley ..... A63B 21/0726

OTHER PUBLICATIONS

Product listing for 2-Tier Mass Storage System—43" from https://web.archive.org/web/20170710064814/http://www.roguefitness.com:80/2-tier-mass-storage-system-43, dated Jul. 10, 2017.
Product listing for 3-Tier Mass Storage System—43" from https://web.archive.org/web/20170621060447/http://www.roguefitness.com/3-tier-mass-storage-system-43, dated Jun. 21, 2017.
Product listing for 2-Tier Mass Storage System—70" from https://web.archive.org/web/20170718163236/http://www.roguefitness.com:80/2-tier-mass-storage-system-70, dated Jul. 18, 2017.
Product listing for 3-Tier Mass Storage System—70" from https://web.archive.org/web/20170621022248/http://www.roguefitness.com/3-tier-mass-storage-system-70, dated Jun. 21, 2017.
Product listing for Rogue Universal Storage System 2.0 from https://web.archive.org/web/20170701060527/http://www.roguefitness.com:80/rogue-universal-storage-system-2-0, dated Jul. 1, 2017.
Photos of Rogue Universal Storage System 2.0 from https://web.archive.org/web/20170701060527/http://www.roguefitness.com:80/rogue-universal-storage-system-2-0, dated Jul. 1, 2017.
Product listing for Rogue Mass Storage Add-Ons from https://web.archive.org/web/20170620230340/http://www.roguefitness.com/rogue-mass-storage-add-ons, dated Jun. 20, 2017.
Product listing for Rogue 3 Tier Dumbbell Rack from https://web.archive.org/web/20170719122936/http://www.roguefitness.com:80/rogue-3-tier-dumbbell-rack, dated Jul. 19, 2017.

* cited by examiner

WEIGHT RACK AND SHELF

CROSS REFERENCE TO RELATED APPLICATION

This application is a non-provisional of, and claims priority to, U.S. Provisional Application No. 62/637,843, filed Mar. 2, 2018, which prior application is incorporated by reference herein in its entirety.

FIELD OF THE INVENTION

This disclosure relates to rack assemblies for weightlifting and other exercise, and more specifically to weight racks and structures for mounting and supporting weight racks on such a rack assembly.

BACKGROUND

Rack assemblies having many different configurations are used in gyms of all sizes and layouts, and include structures for facilitating many different kinds of exercise. For example, such rack assemblies may include structures to support weights for many weightlifting exercises, including various squats, presses, and lifts, among others, as well as structures for use in body weight exercises such as chin-ups, dips, etc. As another example, such rack assemblies may additionally or alternately include weight racks and other structures for storage of weights and equipment. Many rack assemblies must include structures that are able to support a considerable amount of weight and withstand impact forces, in order to avoid failure during use. This is typically accomplished through use of multiple high-strength support members. However, increasing the number of support members can increase both the cost and complexity of assembly of such rack assemblies. Thus, there is a need for rack assembly structures that reduce the necessary number of support members and increase the simplicity of assembly, without unacceptable reduction in strength or stability of the rack assembly.

The present disclosure is provided to address this need and other needs in existing rack assemblies and weight racks for such assemblies. A full discussion of the features and advantages of the present invention is deferred to the following detailed description, which proceeds with reference to the accompanying drawings.

BRIEF SUMMARY

General aspects of the present disclosure relate to shelves for use in weight racks and are configured to mountable on the weight rack using only two vertical support members to support each shelf. For example, aspects of the disclosure relate to a weight rack that includes a first vertical member and a second vertical member extending generally parallel to each other and positioned in spaced relation to each other and a shelf configured to support one or more free weights and having first and second opposed ends and front and rear sides extending between the first and second ends, where the first end of the shelf is connected to the first vertical member and the second end of the shelf is connected to the second vertical member, such that the first vertical member and the second vertical member support an entire weight of the shelf. As another example, aspects of the disclosure relate to a shelf for use with a weight rack, including a shelf body configured to support one or more free weights and having first and second opposed ends spaced from each other in a horizontal direction and front and rear sides spaced from each other in a lateral direction and extending between the first and second ends in the horizontal direction, where the shelf body is configured for connection to first and second vertical members at the first and second ends, respectively, such that the first vertical member and the second vertical member support the shelf, and a rotation limiting structure connected to the shelf body and configured to engage at least one of the first and second vertical members to limit rotation of the shelf with respect to the first and second vertical members.

Aspects of the disclosure relate to a weight rack that includes a first vertical member and a second vertical member extending generally parallel to each other and positioned in spaced relation to each other and a shelf mounted on the first and second vertical members and configured to support one or more free weights. The shelf has first and second opposed ends and front and rear sides extending between the first and second ends, and the first end of the shelf is connected to the first vertical member and the second end of the shelf is connected to the second vertical member, such that the first vertical member and the second vertical member support an entire weight of the shelf. The weight rack further includes a rotation limiting structure engaging the shelf and at least one of the first and second vertical members and configured to limit rotation of the shelf with respect to the first and second vertical members.

According to one aspect, the rotation limiting structure includes a first projection connected to the first end of the shelf and configured to abuttingly engage the first vertical member to limit rotation of the shelf with respect to the first and second vertical members. The rotation limiting structure may further include a second projection connected to the second end of the shelf and configured to abuttingly engage the second vertical member to limit rotation of the shelf with respect to the first and second vertical members.

According to another aspect, the rotation limiting structure includes a first pair of projections connected to the first end of the shelf at different vertical locations and configured to abuttingly engage the first vertical member to limit rotation of the shelf with respect to the first and second vertical members. The rotation limiting structure may further include a second pair of projections connected to the second end of the shelf at different vertical locations and configured to abuttingly engage the second vertical member to limit rotation of the shelf with respect to the first and second vertical members.

According to a further aspect, the first and second vertical members each have a fastener hole, and the first and second fasteners are bolts or pins extending through the fastener holes of the first and second vertical members and engaging the first and second ends of the shelf to connect the shelf to the first and second vertical members.

According to yet another aspect, the weight rack further includes a cover covering at least a portion of a top surface of the shelf and configured to support the one or more free weights. The cover includes a first flange and a second flange depending from opposed ends of the cover, with the first flange positioned such that the first fastener engages the first vertical member, the first end of the shelf, and the first flange to connect the cover to the shelf and the first vertical member, and the second flange positioned such that the second fastener engages the second vertical member, the second end of the shelf, and the second flange to connect the cover to the shelf and the second vertical member.

According to yet another aspect, the shelf includes a cross-member configured to support the one or more free weights, a first end piece connected to the cross-member at the first end, and a second end piece connected to the cross-member at the second end, where the first pair of projections extend outwardly from the first end piece, and the second pair of projections extend outwardly from the second end piece. In one configuration, the first end piece and the second end piece each have a receiver, and the cross-member is received within the receivers on the first and second end pieces to connect the first and second end pieces to the cross-member. Additionally, in one configuration, the shelf further includes a second cross-member spaced from the cross-member and configured to support the one or more free weights in combination with the cross-member, where the second cross member is connected to the first end piece at the first end and is connected to the second end piece at the second end. In this configuration, the first end piece and the second end piece may each include a first receiver and a second receiver, where the cross-member is received within the first receivers on the first and second end pieces to connect the first and second end pieces to the cross-member, and the second cross-member is received within the second receivers on the first and second end pieces to connect the first and second end pieces to the second cross-member. The weight rack may further include a cover covering at least a portion of a top side of the shelf and configured to support the one or more free weights, where the cover includes engagement portions for engaging the cross-member and the second cross-member, such as first and second elongated, recessed channels defined in a bottom surface of the cover, and a span extending between the first and second engagement portions. In this configuration, the cross-member and the second cross-member are at least partially received within the first and second channels, respectively, such that the span extends across a space between the first and second cross-members.

Additional aspects of the disclosure relate to a weight rack that includes a first vertical member and a second vertical member extending generally parallel to each other and positioned in spaced relation to each other, and a shelf mounted on the first and second vertical members and configured to support one or more free weights. The shelf has first and second opposed ends and front and rear sides extending between the first and second ends, where the first end of the shelf is connected to the first vertical member and the second end of the shelf is connected to the second vertical member, such that the first vertical member and the second vertical member support an entire weight of the shelf. The first end of the shelf has a first connection structure and a first pair of projections, with the first pair of projections positioned between the first connection structure and the rear side of the shelf, and with the first pair of projections being spaced from each other and located on opposite vertical sides of the first connection structure. The second end of the shelf has a second connection structure and a second pair of projections, with the second pair of projections positioned between the second connection structure and the rear side of the shelf, and with the second pair of projections being spaced from each other and located on opposite vertical sides of the second connection structure. A first fastener connects the first connection structure to the first vertical member, and a second fastener connects the second connection structure to the second vertical member. The first pair of projections are configured to engage the first vertical member, e.g., by abutment, to limit rotation of the shelf with respect to the first vertical member, and the second pair of projections are configured to engage the second vertical member, e.g., by abutment, to limit rotation of the shelf with respect to the second vertical member. The weight rack may include any of the aspects and embodiments described herein.

Other aspects of the disclosure relate to a weight rack that includes one or more additional shelves that may be similar or identical to the shelves according to aspects described above. In one configuration, the weight rack includes a number of vertical members including the first vertical member and the second vertical member and a number of adjacent shelf stacks including the shelf that are supported by the vertical members, where the number of shelf stacks is N and the number of vertical members is N+1.

Aspects of the disclosure relate to a shelf for use with a weight rack, the shelf including a shelf body configured to support one or more free weights and having first and second opposed ends spaced from each other in a horizontal direction and front and rear sides spaced from each other in a lateral direction and extending between the first and second ends in the horizontal direction. A first connection structure is positioned at the first end of the shelf body, and a second connection structure is positioned at the second end of the shelf body, where the first connection structure and the second connection structure are configured for connection to first and second vertical members, respectively, such that the first vertical member and the second vertical member support the shelf. A first projection is connected to the first end of the shelf body and positioned between the first connection structure and the rear side of the shelf body, and a second projection is connected to the second end of the shelf body and positioned between the second connection structure and the rear side of the shelf body. The first projection and the second projection are configured to engage the first and second vertical members when the shelf body is connected to the first and second vertical members to limit rotation of the shelf with respect to the first and second vertical members.

According to one aspect, the shelf body further includes a cross-member configured to support the one or more free weights, a first end piece connected to the cross-member at the first end, and a second end piece connected to the cross-member at the second end, where the first projection extends outwardly from the first end piece, and the second projection extends outwardly from the second end piece. In one configuration, the first projection is formed as part of a first integral piece with the first end piece, and the second projection is formed as part of a second integral piece with the second end piece. Additionally, in one configuration, the first end piece and the second end piece each have a receiver, and the cross-member is received within the receivers on the first and second end pieces to connect the first and second end pieces to the cross-member. The shelf body may also include a second cross-member extending parallel to the cross-member and spaced from the cross-member, where the second cross-member is configured to support the one or more free weights in combination with the cross-member, and the second cross member is connected to the first end piece at the first end and is connected to the second end piece at the second end. In one configuration, the first end piece and the second end piece each have a first receiver and a second receiver, the cross-member is received within the first receivers on the first and second end pieces to connect the first and second end pieces to the cross-member, and the second cross-member is received within the second receivers on the first and second end pieces to connect the first and second end pieces to the second cross-member. In this configuration, the first connection structure may be positioned on the first end piece between the first and second receivers thereof, and the second connection structure may be positioned on the second end piece between the first and second receivers thereof. The first receivers and the second receivers of the first and second end pieces may have non-circular shapes, and the cross-member and the second cross-member may have non-circular shapes that are complementary to the non-circular shapes of the first receivers and the second receivers.

According to another aspect, the shelf body further includes a cross-member configured to support the one or more free weights, a first end piece connected to the cross-member at the first end, and a second end piece connected to the cross-member at the second end, and the shelf further includes a third projection connected to the first end of the shelf body and positioned between the first connection structure and the rear side of the shelf body and a fourth projection connected to the second end of the shelf body and positioned between the second connection structure and the rear side of the shelf body. In one configuration, the first and third projections are spaced vertically from each other, and the second and fourth projections are spaced vertically from each other. Additionally, in one configuration, the first and third projections are located on opposite vertical sides of the first connection structure, and the second and fourth projections are located on opposite vertical sides of the second connection structure. Further, in one configuration, the first and second projections are located at a first vertical distance relative to the first and second connection structures, and the third and fourth projections are located at a second vertical distance relative to the first and second connection structures, such that the second vertical distance is different from the first vertical distance.

Additional aspects of the disclosure relate to a shelf for use with a weight rack, the shelf including a shelf body configured to support one or more free weights and having first and second opposed ends spaced from each other in a horizontal direction and front and rear sides spaced from each other in a lateral direction and extending between the first and second ends in the horizontal direction. In this configuration, the horizontal direction is perpendicular to the lateral direction, and a vertical direction is defined perpendicular to the horizontal direction and transverse to the lateral direction. The vertical direction may perpendicular to both the lateral and horizontal directions in one embodiment. The shelf also includes a first connection structure at the first end of the shelf body and a second connection structure at the second end of the shelf body, where the first connection structure and the second connection structure are configured for connection to first and second vertical members, respectively, such that the first vertical member and the second vertical member support the shelf. A first pair of projections are connected to the first end of the shelf body, and a second pair of projections are connected to the second end of the shelf body. The first pair of projections are positioned between the first connection structure and the rear side of the shelf body, and the first pair of projections are spaced from each other and located on opposite sides, in the vertical direction, of a first laterally-extending line passing through a center of the first connection structure. The second pair of projections are positioned between the second connection structure and the rear side of the shelf body, and the second pair of projections are spaced from each other and located on opposite sides, in the vertical direction, of a second laterally-extending line passing through a center of the second connection structure. At least one of the first pair of projections and at least one of the second pair of projections are configured to engage the first and second vertical members when the shelf body is connected to the first and second vertical members to limit rotation of the shelf with respect to the first and second vertical members. The shelf may include any of the aspects and embodiments described herein.

According to one aspect, the shelf body includes a cross-member extending horizontally and configured to support the one or more free weights, a first end piece connected to the cross-member at the first end, and a second end piece connected to the cross-member at the second end, the first and second end pieces extending laterally. In this configuration, the first pair of projections may be formed as part of a first integral piece with the first end piece, and the second pair of projections may be formed as part of a second integral piece with the second end piece.

Further aspects of the disclosure relate to a shelf for use with a weight rack, the shelf including a shelf body configured to support one or more free weights and having first and second opposed ends and front and rear sides extending between the first and second ends, a first connection structure at the first end of the shelf body, and a second connection structure at the second end of the shelf body. The first connection structure and the second connection structure are configured for connection to first and second vertical members, respectively, such that the first vertical member and the second vertical member support an entire weight of the shelf. The shelf further includes a rotation limiting structure connected to the shelf body and configured to engage at least one of the first and second vertical members to limit rotation of the shelf with respect to the first and second vertical members.

According to one aspect, the rotation limiting structure includes a first projection connected to the first end and positioned between the first connection structure and the rear side of the shelf body, and a second projection connected to the second end and positioned between the second connection structure and the rear side of the shelf body. The rotation limiting structure may further include a third projection connected to the first end and positioned between the first connection structure and the rear side of the shelf body and a fourth projection connected to the second end and positioned between the second connection structure and the rear side of the shelf body. In one configuration, the first and third projections are spaced vertically from each other, and the second and fourth projections are spaced vertically from each other. Additionally, in one configuration, the first and third projections are located on opposite vertical sides of the first connection structure, and the second and fourth projections are located on opposite vertical sides of the second connection structure. Further, in one configuration, the first and second projections are located at a first vertical distance relative to the first and second connection structures, and the third and fourth projections are located at a second vertical distance relative to the first and second connection structures, such that the second vertical distance is different from the first vertical distance.

According to another aspect, the shelf further includes a cover covering at least a portion of a top surface of the shelf and configured to support the one or more free weights. The cover has a first flange and a second flange depending from opposed ends of the cover, where the first flange has a first fastener hole adjacent to and aligned with the first connection structure such that the first fastener hole and the first connection structure are configured to receive a first fastener for connection to the first vertical member, and the second flange has a second fastener hole adjacent to and aligned with the second connection structure such that the second fastener hole and the second connection structure are configured to receive a second fastener for connection to the second vertical member.

According to a further aspect, the shelf body further includes a first cross-member and a second cross-member spaced from the first cross-member, the first and second cross-members being configured to support the one or more free weights, a first end piece connected to the first and second cross-members at the first end, and a second end piece connected to the first and second cross-members at the second end. The first end piece and the second end piece each include a first receiver and a second receiver, the first cross-member is received within the first receivers on the first and second end pieces to connect the first and second end pieces to the first cross-member, and the second cross-member is received within the second receivers on the first and second end pieces to connect the first and second end pieces to the second cross-member. In one configuration, the first connection structure is located at a center of the first end piece and between the first and second receivers of the first end piece, and the second connection structure is located at a center of the second end piece and between the first and second receivers of the second end piece. Additionally, in one configuration, the first receivers and the second receivers of the first and second end pieces have non-circular shapes, and the cross-member and the second cross-member have non-circular shapes that are complementary to the non-circular shapes of the first receivers and the second receivers.

Still further aspects of the disclosure relate to a shelf for use with a weight rack, the shelf including a shelf body with first and second opposed ends and having a first cross-member and a second cross-member spaced from the first cross-member, the first and second cross-members configured to support one or more free weights, a first end piece connected to the first and second cross-members at the first end, and a second end piece connected to the first and second cross-members at the second end. The first end piece and the second end piece each include a first receiver and a second receiver, the first cross-member is received within the first receivers on the first and second end pieces to connect the first and second end pieces to the first cross-member, and the second cross-member is received within the second receivers on the first and second end pieces to connect the first and second end pieces to the second cross-member. The shelf has a first aperture at a center of the first end piece, located between the first and second receivers of the first end piece and configured to receive a first fastener for connection to a first vertical member, and a second aperture at a center of the second end piece, located between the first and second receivers of the second end piece and configured to receive a second fastener for connection to a second vertical member. The shelf is configured connection to first and second vertical members such that the first vertical member and the second vertical member support an entire weight of the shelf. A rotation limiting structure is connected to the shelf body and configured to engage at least one of the first and second vertical members to limit rotation of the shelf with respect to the first and second vertical members. The shelf may include any of the aspects and embodiments described herein.

According to one aspect, the shelf further includes a first projection and a third projection connected to the first end piece and positioned between the first aperture and the first receiver of the first end piece and a second projection and a fourth projection connected to the second end piece and positioned between the second aperture and the second receiver of the second end piece. In this configuration, the first projection and/or the third projection may be formed as part of a first integral piece with the first end piece, and the second projection and/or the fourth projection may be formed as part of a second integral piece with the second end piece.

Other aspects of the disclosure relate to a weight rack that includes one or more shelves that may be similar or identical to the shelves described above. In one configuration, the weight rack includes a number of vertical members including the first vertical member and the second vertical member and a number of shelves including the shelf that are supported by the vertical members, wherein the number of shelves is N and the number of vertical members is N+1.

Still other aspects of the disclosure relate to a method of assembling a weight rack as described herein, using a shelf according to any aspects described herein, which includes providing the weight rack and connecting a shelf to the first and second vertical members. The shelf may be inserted between the first and second vertical members in a direction perpendicular to the vertical direction, prior to connecting the shelf. In one configuration, the shelf has a first connection structure that is connected to the first vertical member, a second connection structure that is connected to the second vertical member, and a rotation limiting structure engaging at least one of the first and second vertical members and configured to limit rotation of the shelf with respect to the first and second vertical members, where the rotation limiting structure is positioned rearward of the first and second connecting structures, and the shelf is inserted from a rear of the weight rack. Connecting the shelf to the first and second vertical members may include inserting first and second fasteners to make these connections.

Other features and advantages of the disclosure will be apparent from the following description taken in conjunction with the attached drawings.

BRIEF DESCRIPTION OF THE DRAWINGS

To allow for a more full understanding of the present disclosure, it will now be described by way of example, with reference to the accompanying drawings in which.

DETAILED DESCRIPTION

Figure 1:
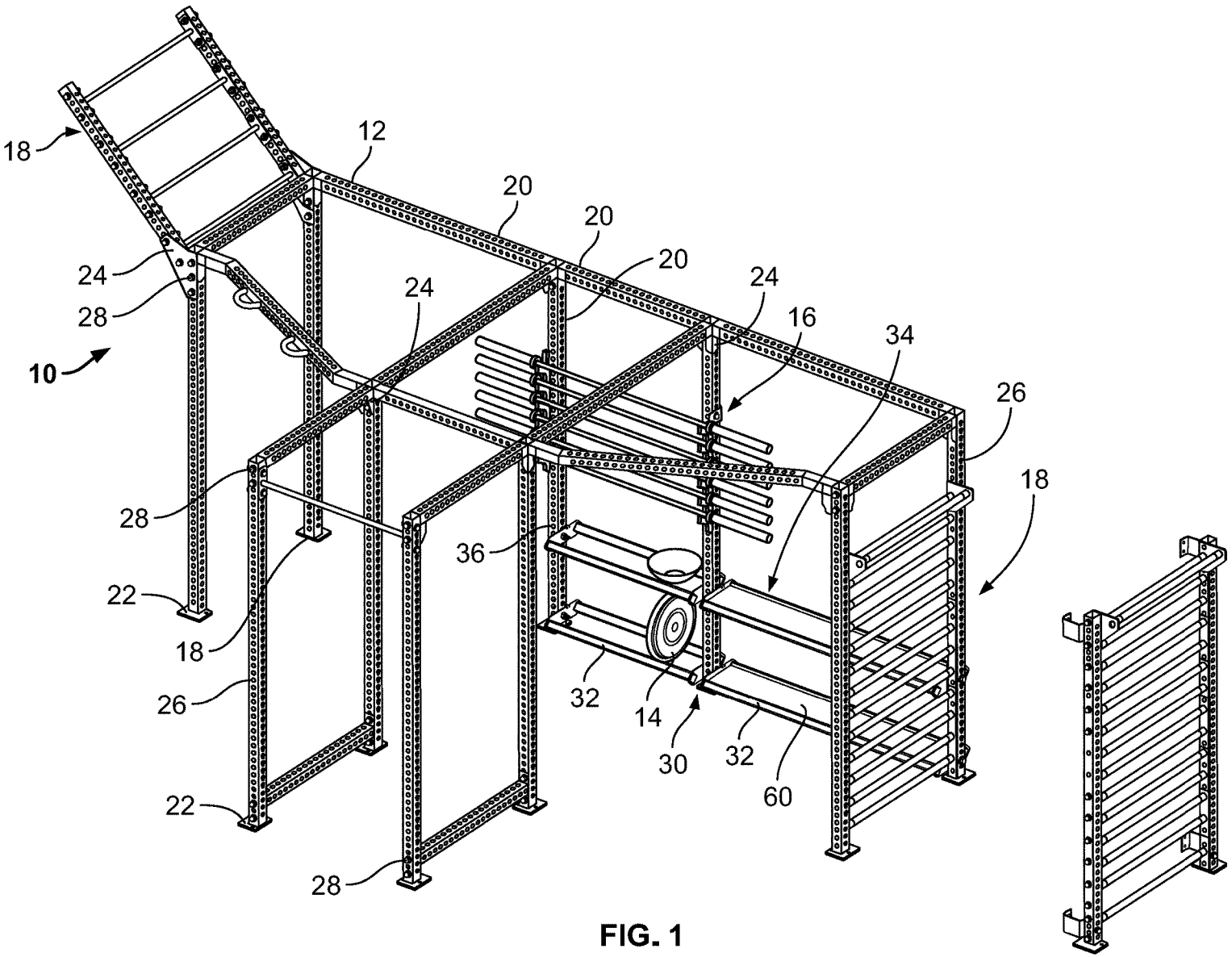
FIG. 1 is a perspective view of one embodiment of a rack assembly according to aspects of the present disclosure, including weight equipment supported by the rack assembly.

While this invention is susceptible of embodiments in many different forms, there are shown in the drawings and will herein be described in detail example embodiments of the invention with the understanding that the present disclosure is to be considered as an exemplification of the principles of the invention and is not intended to limit the broad aspect of the invention to the embodiments illustrated. In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention.

Figure 2:
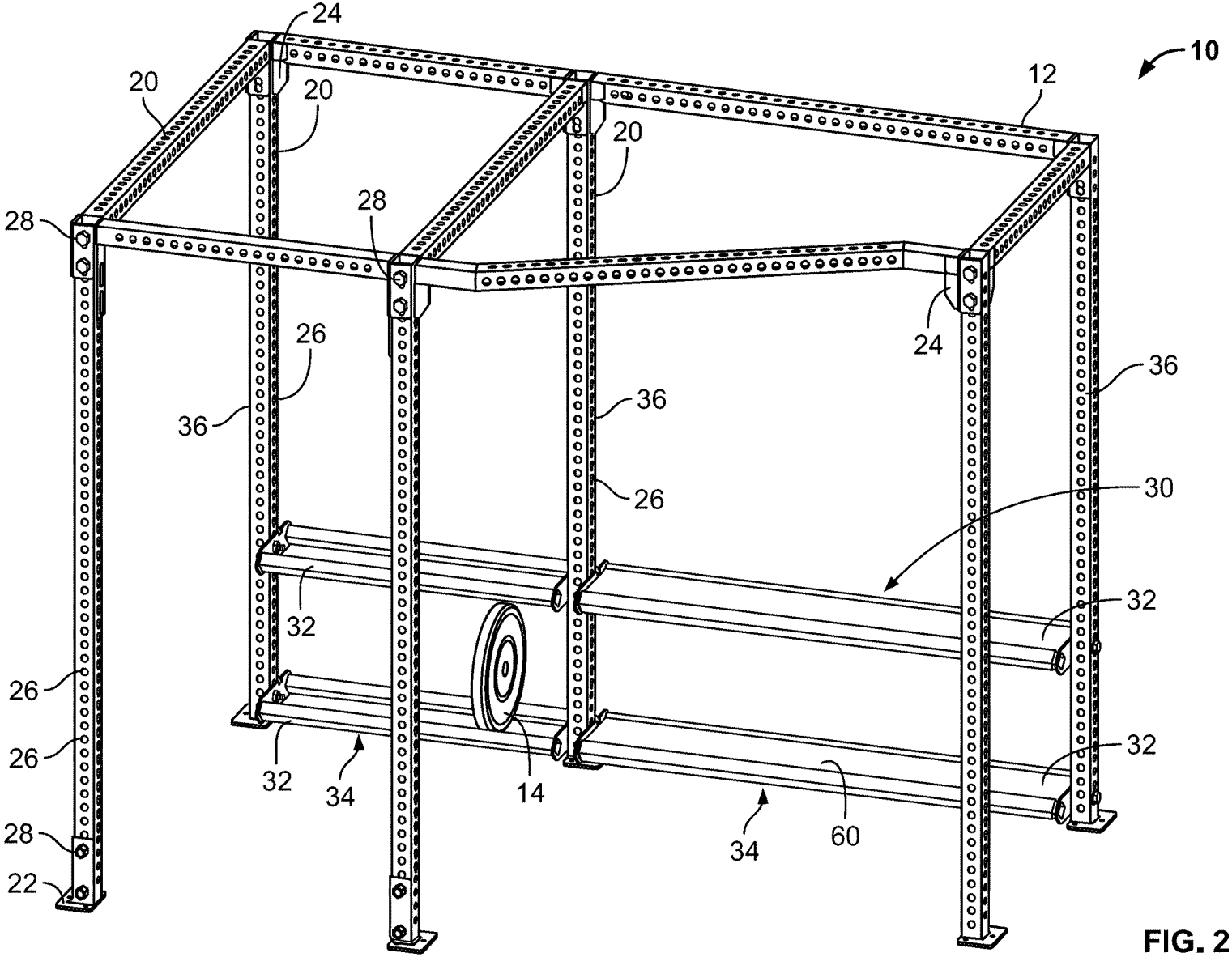
FIG. 2 is a perspective view of a portion of the rack assembly of FIG. 1, including weight equipment supported by a weight rack of the rack assembly.
Figure 3:
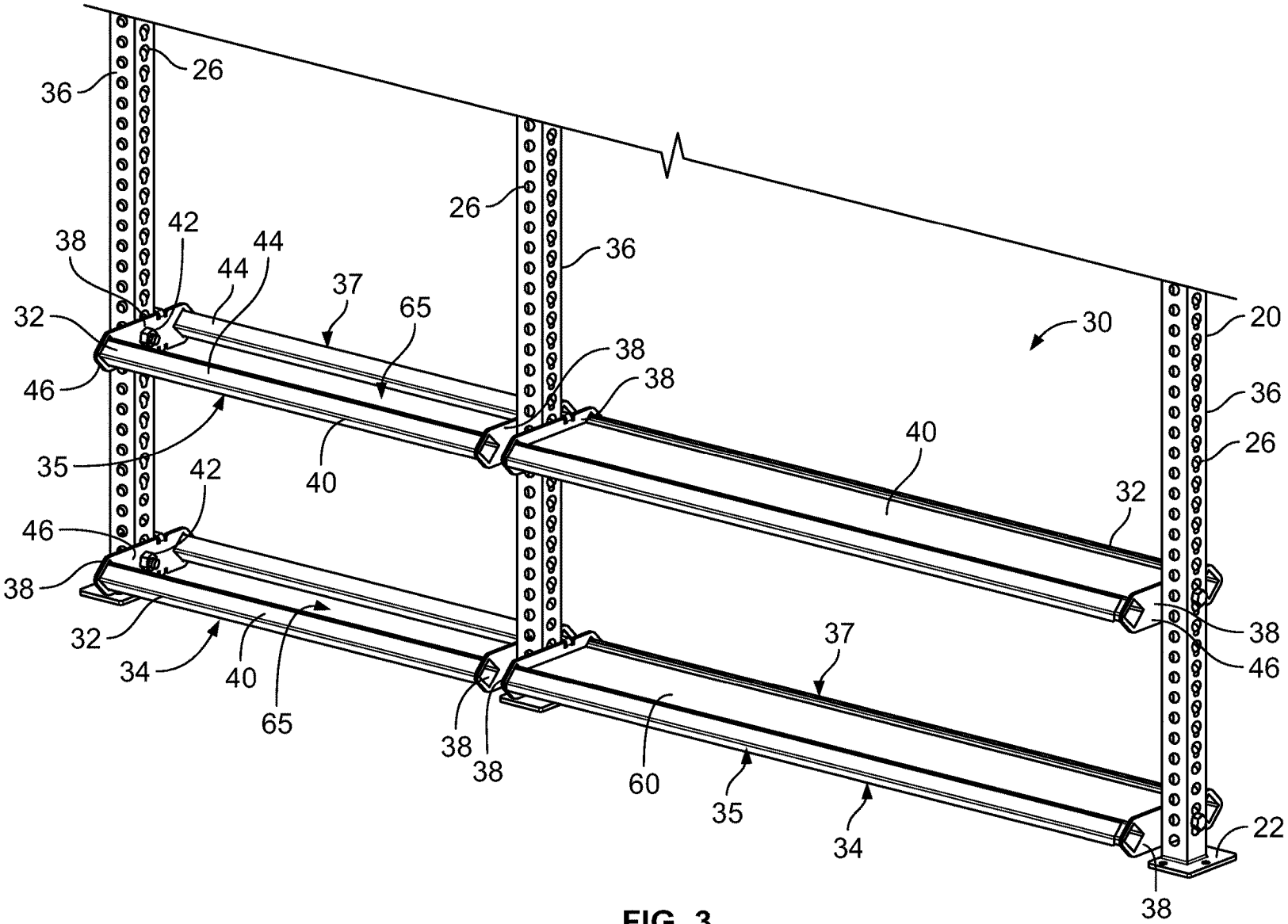
FIG. 3 is a perspective view of the weight rack of the rack assembly of FIG. 2, including four shelves according to embodiments of the present disclosure.
Figure 4:
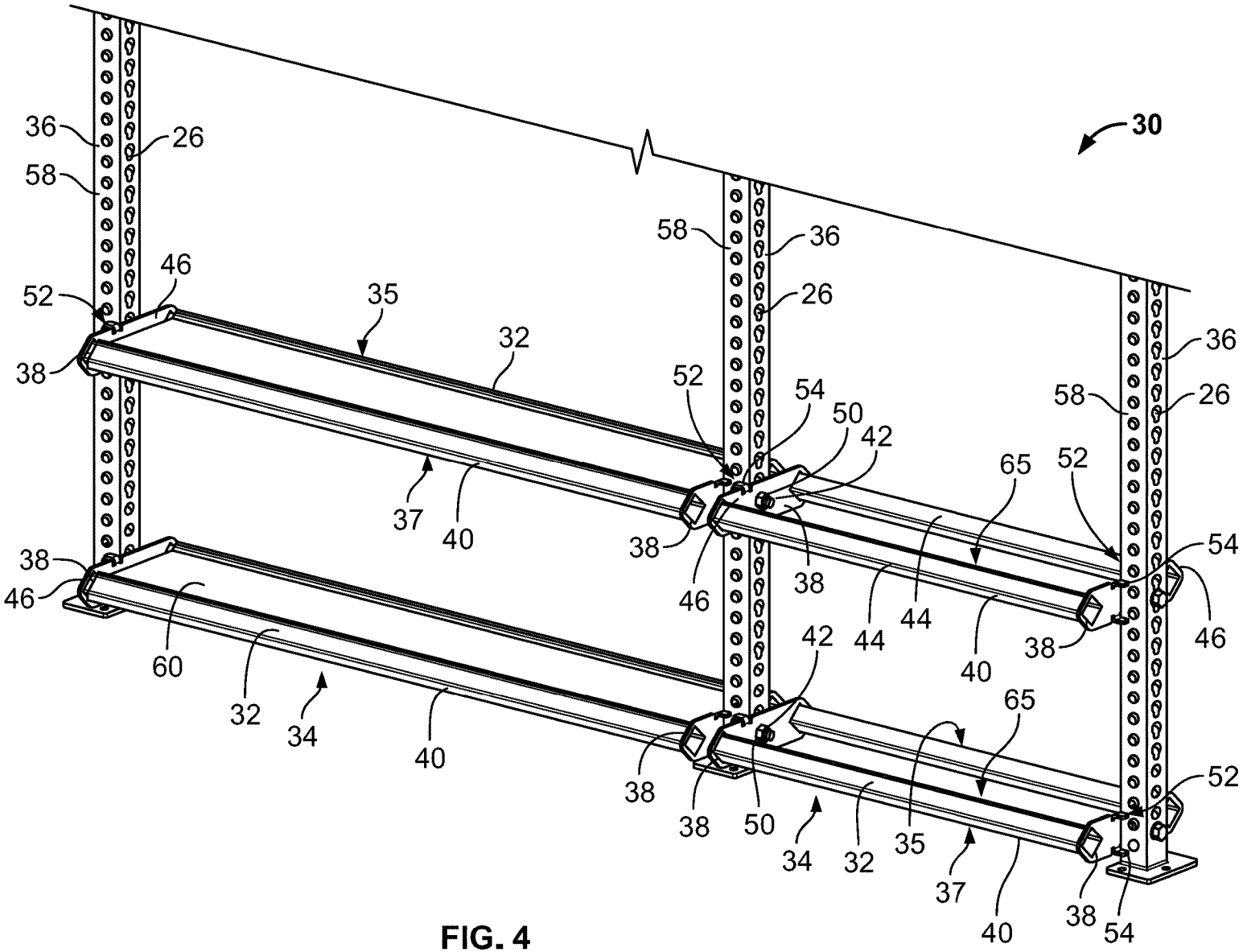
FIG. 4 is a rear perspective view of the weight rack shown in FIG. 3.
Figure 5:
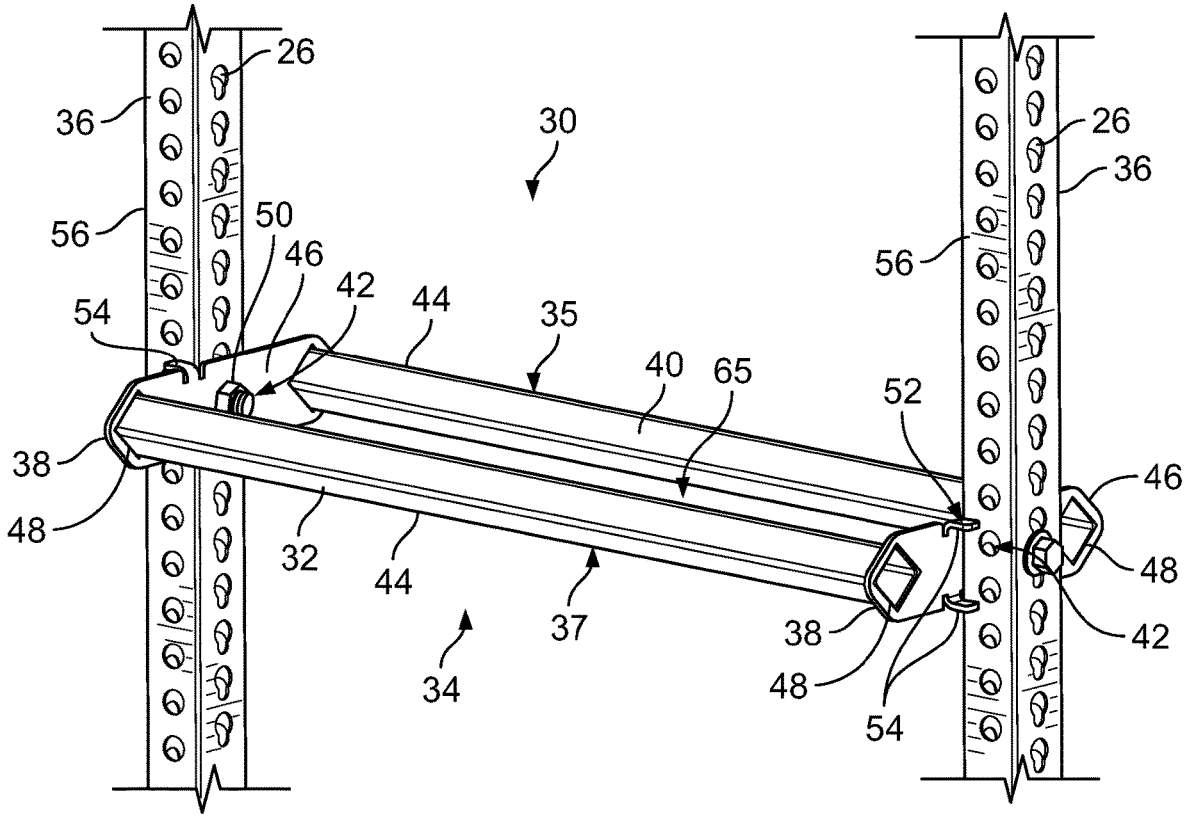
FIG. 5 is a magnified rear perspective view of the weight rack of FIG. 3.

Referring first to FIGS. 1-2, there is shown an example of a rack assembly 10 that includes a frame 12 and a number of weightlifting structures connected to and/or supported by the frame 12, including one or more shelves 32 for a weight rack 30, a barbell rack 16, and various body weight exercise supports 18, including bars, handles, and other structures for use in body weight exercises such as chin-ups, climbing, and others. The frame 12 in this embodiment is primarily formed by a plurality of structural support members or frame members 20 in the form of metal bars, which are arranged and connected to each other as vertical beams, horizontal or lateral cross-beams, and angular beams to support the various structures of the rack assembly 10. The frame members 20 in this embodiment are connected to feet 22 to engage the ground. The frame 12 further includes connectors 24 in the form of brackets or other connecting structures for connecting the frame members 20 together to form the frame 12. The frame members 20 as shown in FIGS. 1-8 are formed as square metal tubes with a hollow interior, and having fastener holes 26 arranged at regular intervals along the lengths of all four surfaces of each frame member 20. This arrangement of fastener holes 26 permits fasteners 28 to extend through each frame member 20 in two transverse directions for connection of various components to any side of the frame member 20, including weightlifting structures, other frame members 20, and other structures. Suitable fasteners 28 include pins (including cotter pins or other locking pins), bolts and other threaded connectors, clamps, and other types of fasteners. The rack assembly 10 and frame 12 structured in the manner illustrated in FIGS. 1-2 and described herein permits construction in a modular manner to provide a wide variety of configurations as desired, including customizable sizes, layouts, and supported weightlifting structures.

The rack assembly 10 in one embodiment includes one or more weight racks 30 each having one or more shelves 32 configured for holding free weights, such as weight plates, dumbbells, kettle bells, etc. The shelves 32 are arranged in shelf stacks 34 in one embodiment, each of which include one or more shelves 32 arranged vertically above each other at different vertical heights. The rack assembly 10 in FIGS. 1-2 includes two vertical stacks of shelves 32, each having two shelves 32 arranged vertically with respect to each other. The two stacks 34 are arranged side-by-side such that the top shelves 32 of the adjacent stacks 34 are generally level and parallel with each other. Any number of adjacent stacks 34 can be constructed in this manner using the structures disclosed herein, and it is understood that adjacent weight racks 30 and/or stacks 34 may be configured with the same or a different number of shelves 32 and/or with shelves 32 in alignment with each other or out of alignment with each other, as desired. The weight rack 30 in FIGS. 1-2 is illustrated in greater detail in FIGS. 3-8, and the shelves 32 of the weight rack 30 of this embodiment are further illustrated in FIGS. 9-16.

Figure 7:
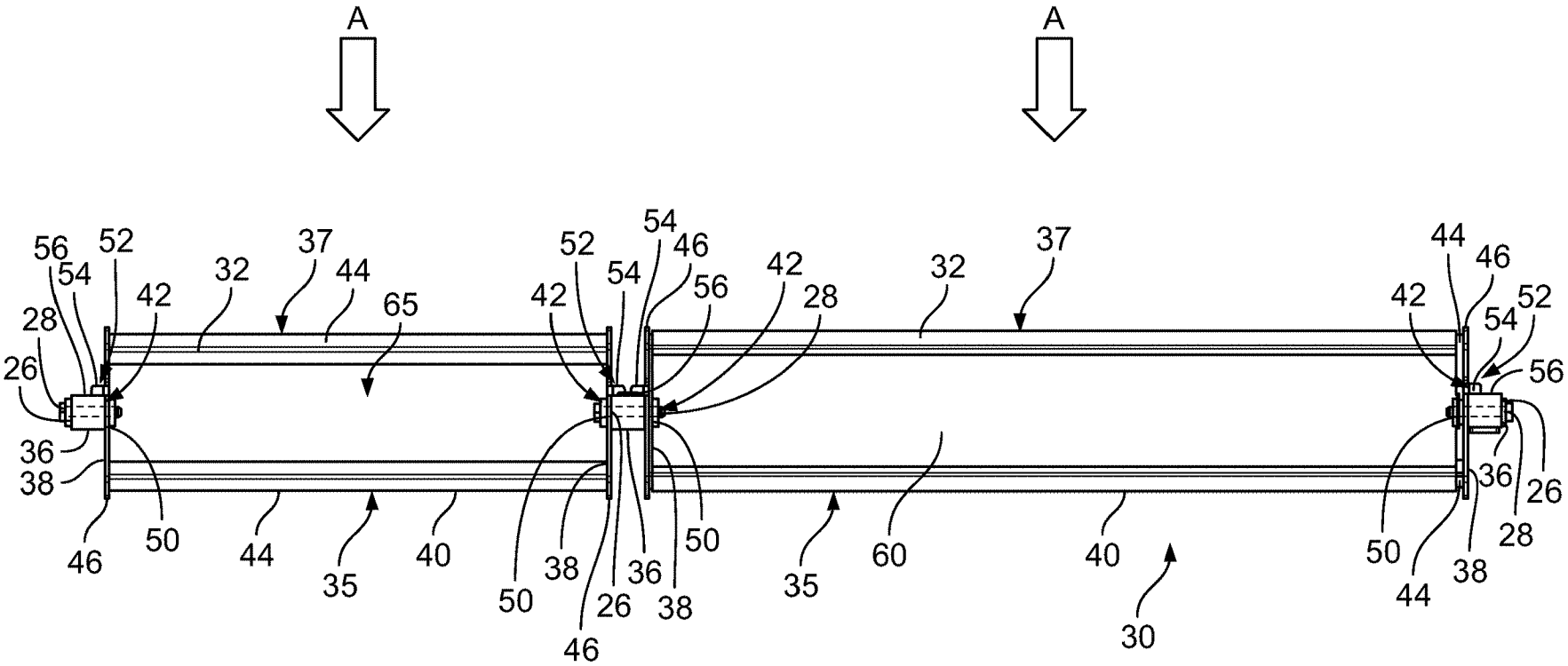
FIG. 7 is a top view of the weight rack shown in FIG. 3.
Figure 8:
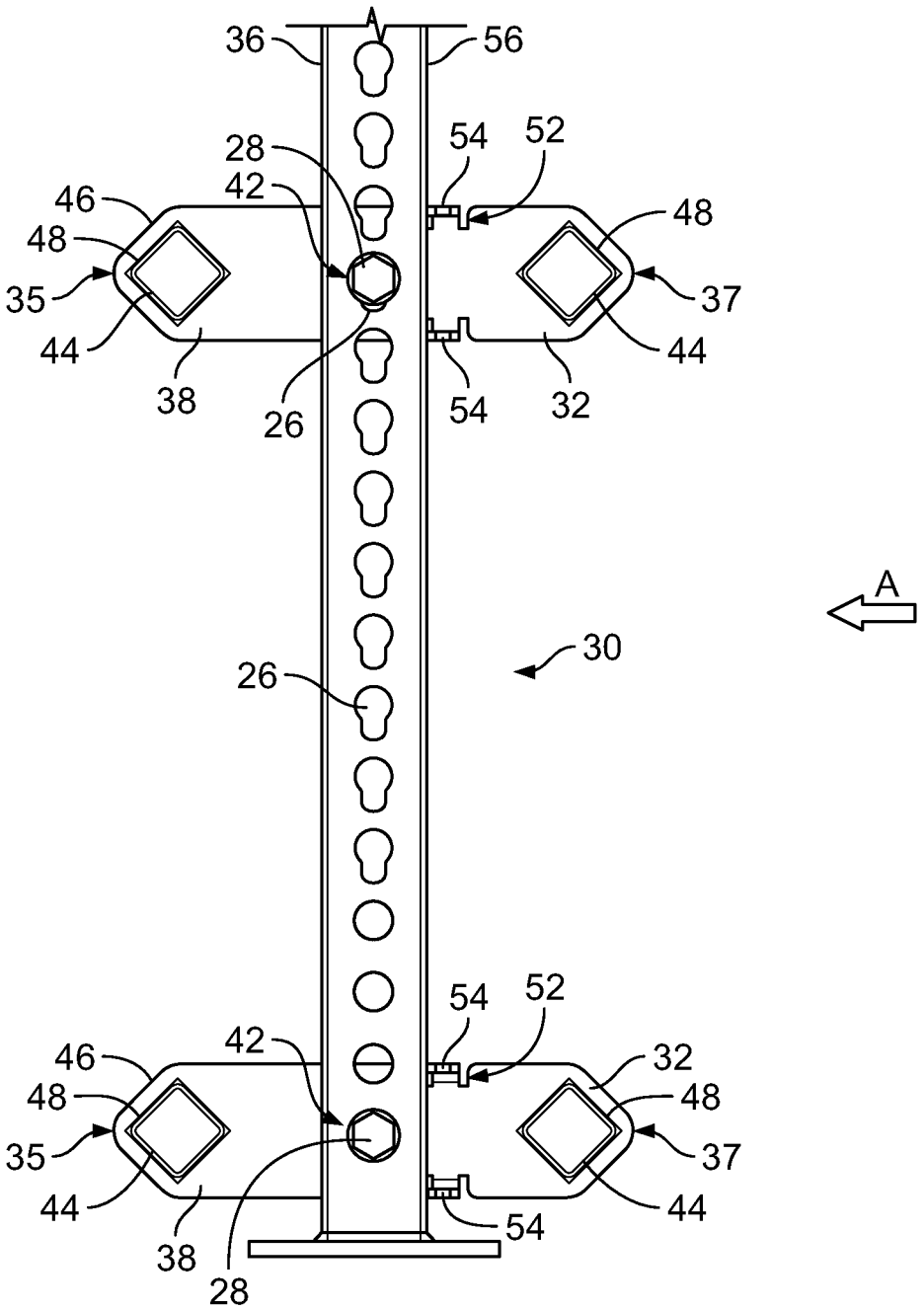
FIG. 8 is a right side view of the weight rack shown in FIG. 3.
Figure 9:
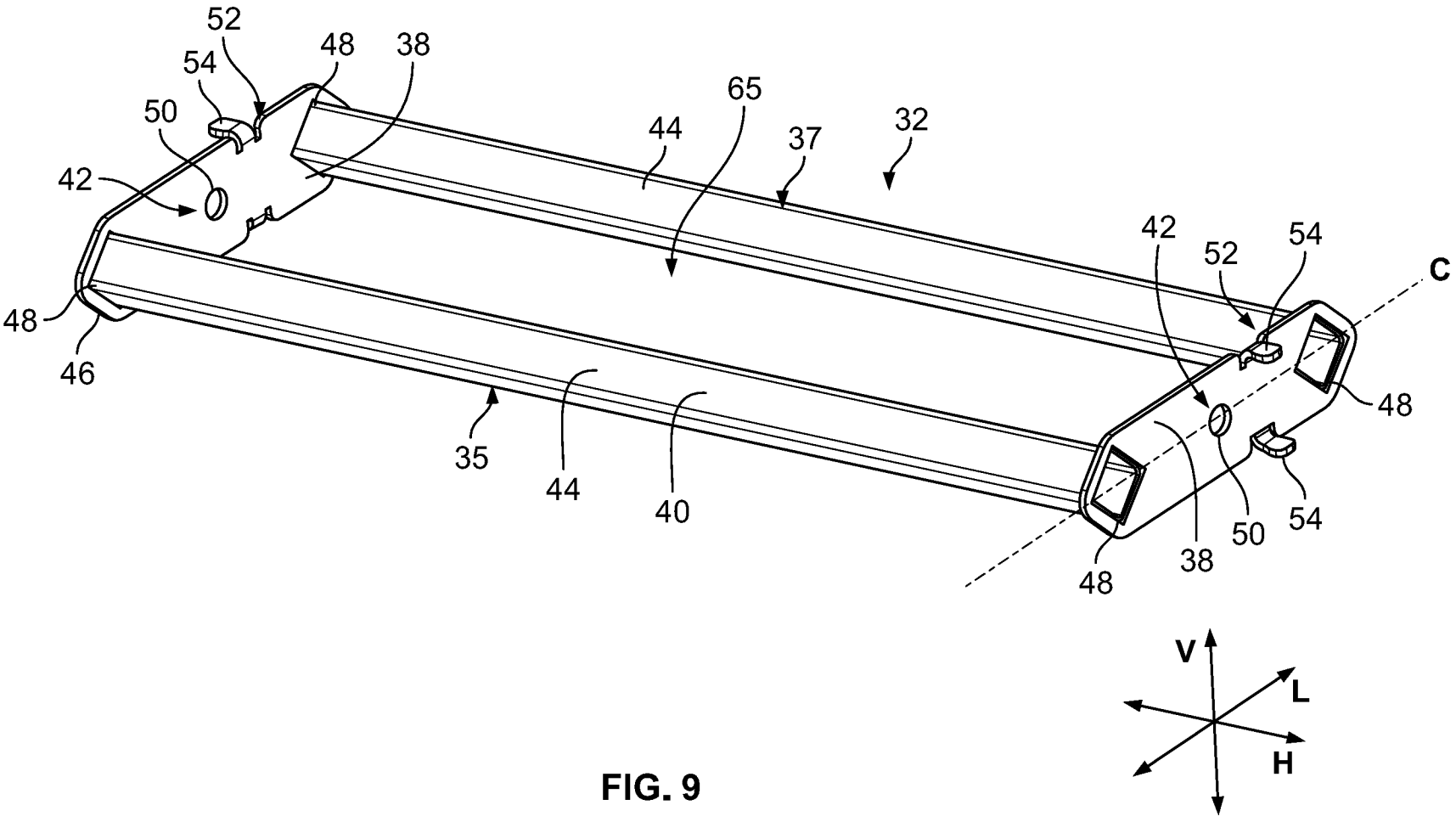
FIG. 9 is a perspective view of a first shelf of the weight rack of FIG. 3.
Figure 10:
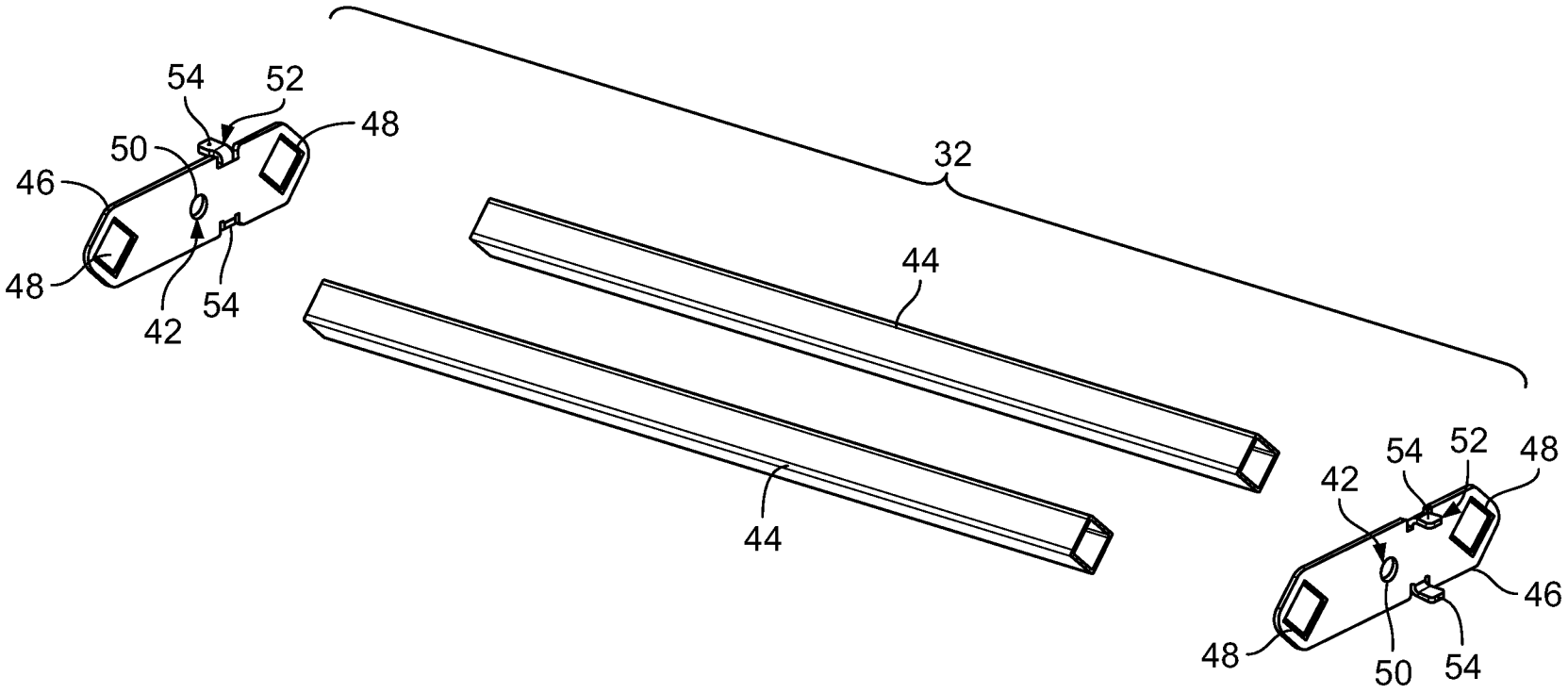
FIG. 10 is an exploded perspective view of the first shelf of FIG. 9.
Figure 11:
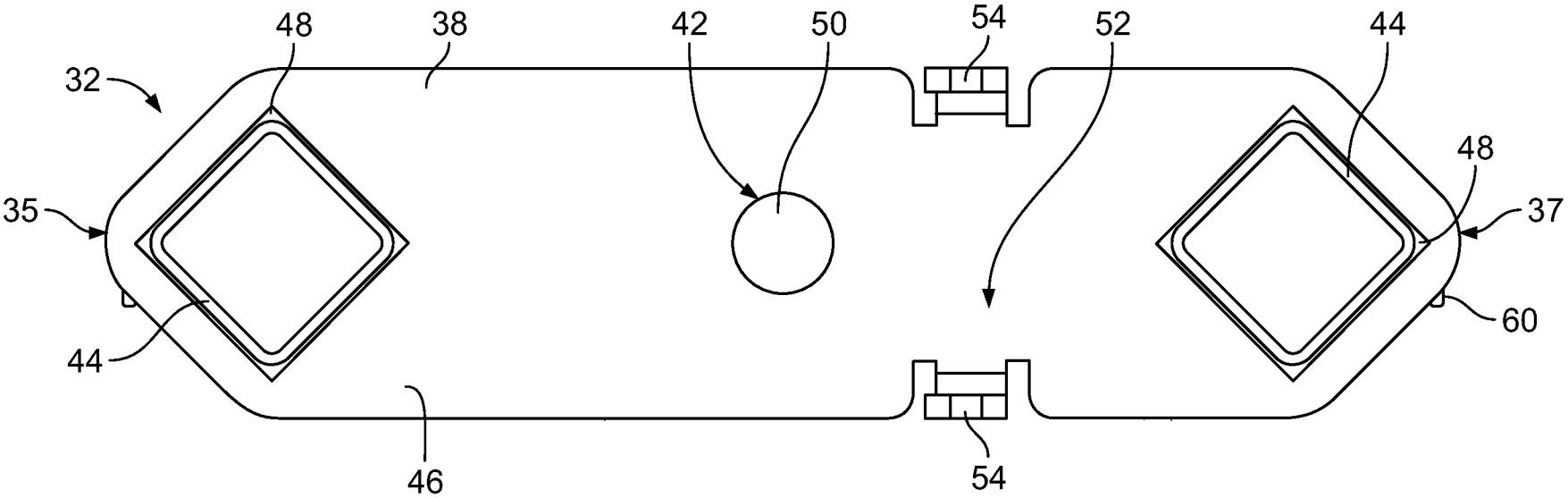
FIG. 11 is a side view of a second shelf of the weight rack of FIG. 3, having a cover attached to the second shelf.
Figure 12:
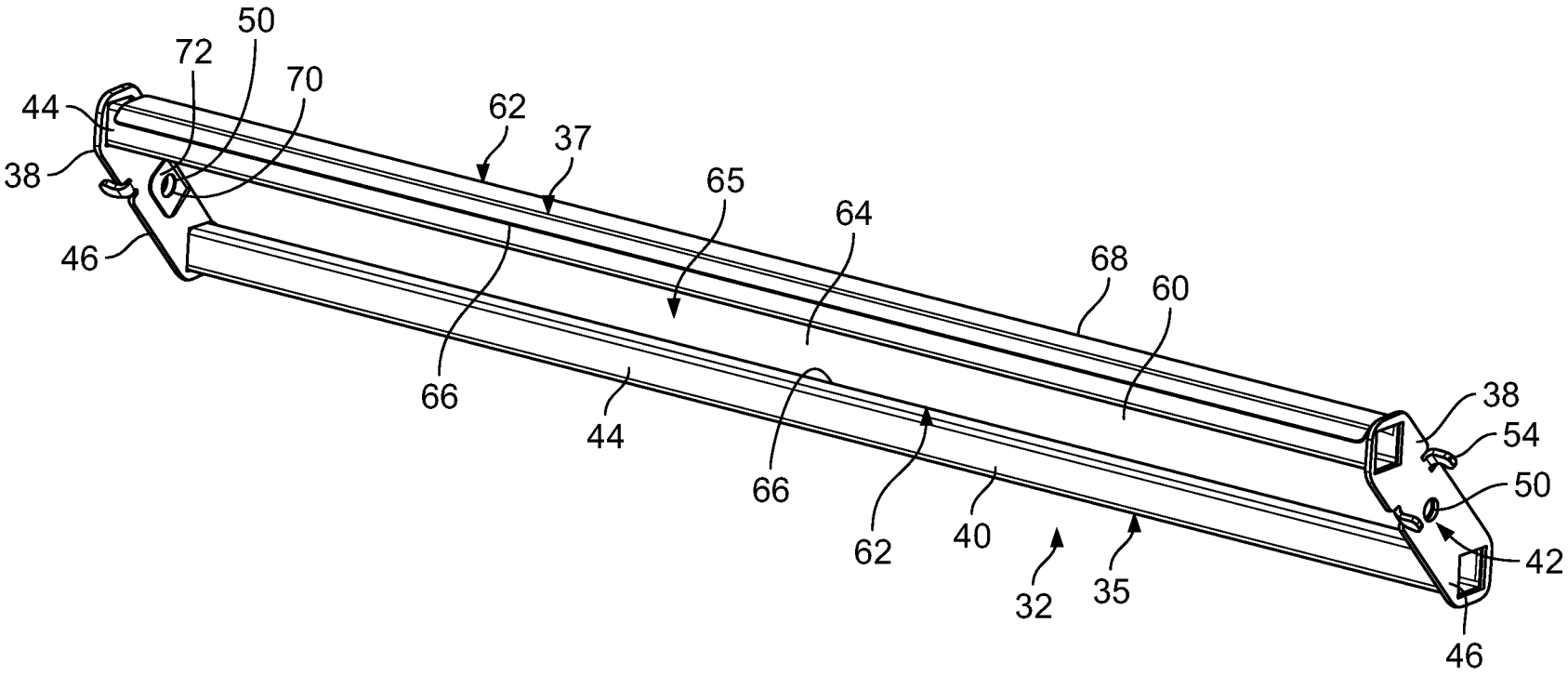
FIG. 12 is a bottom perspective view of the second shelf of FIG. 11.
Figure 13:
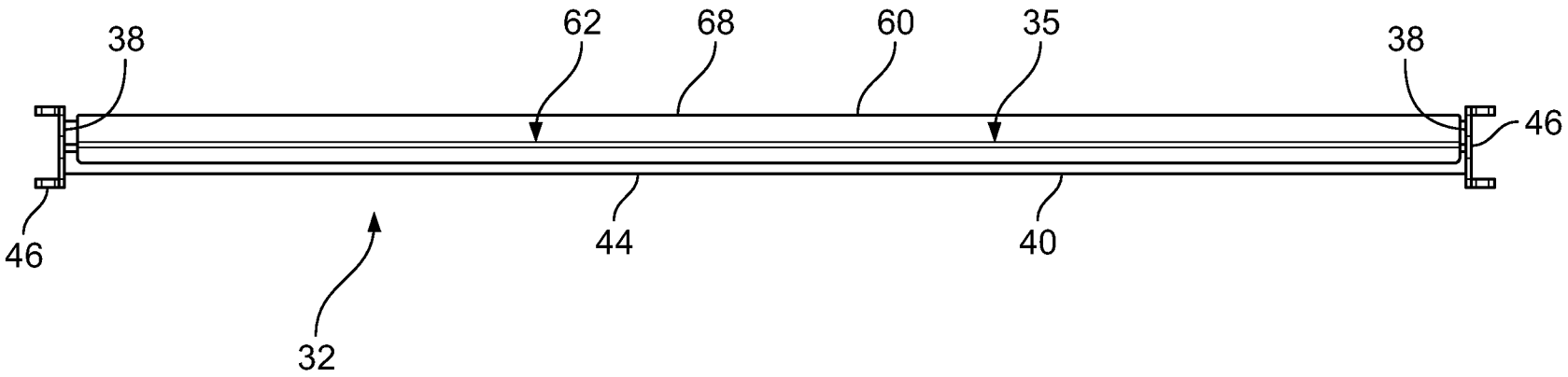
FIG. 13 is a front view of the second shelf of FIG. 11.
Figure 14:
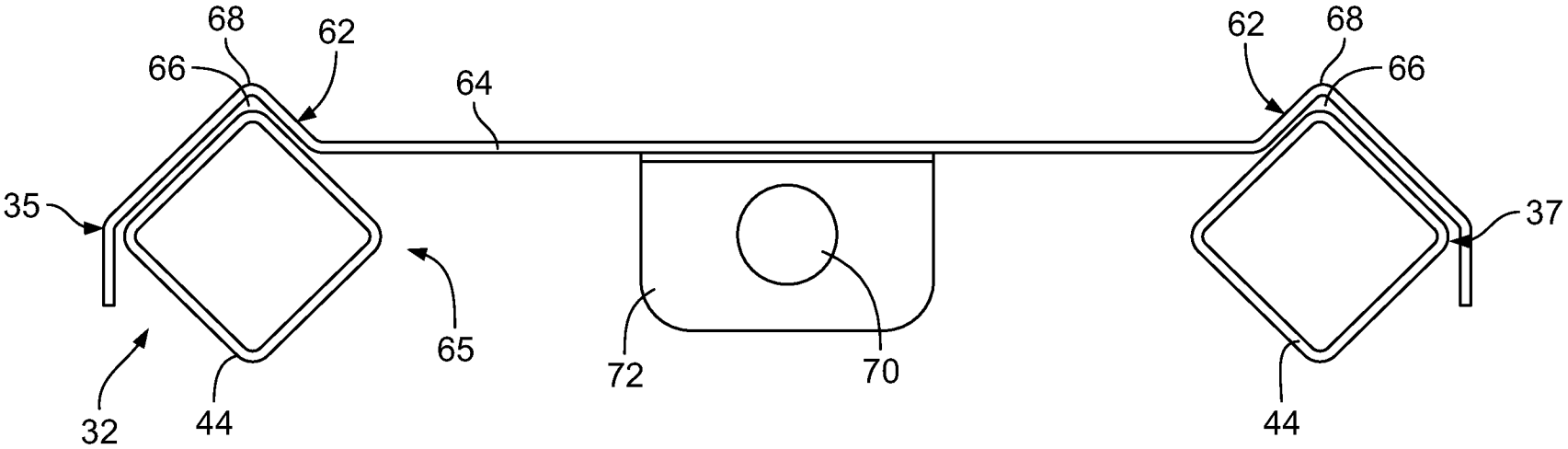
FIG. 14 is a cross-section view of the second shelf of FIG. 11.
Figure 15:
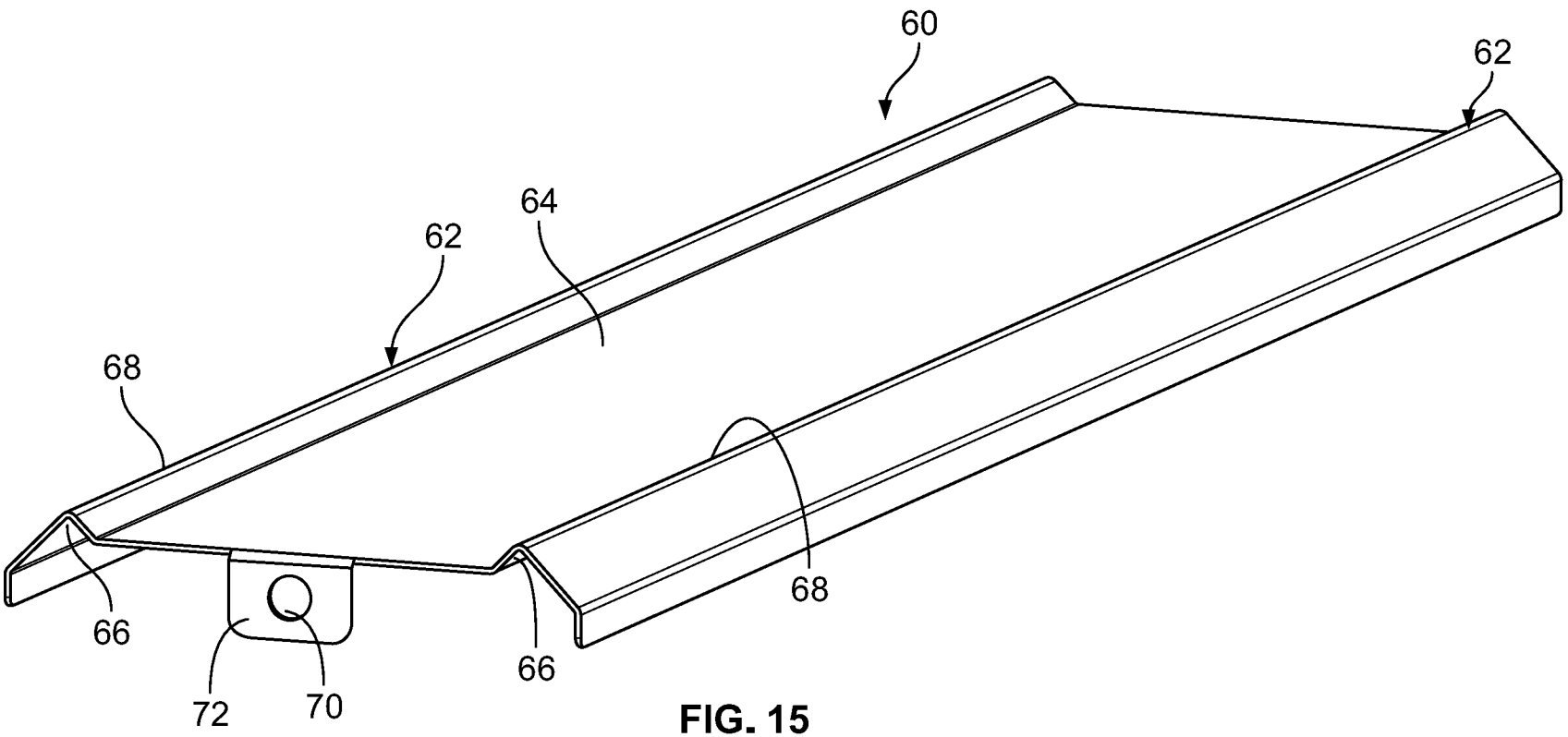
FIG. 15 is a perspective view of the cover of FIG. 11.
Figure 16:
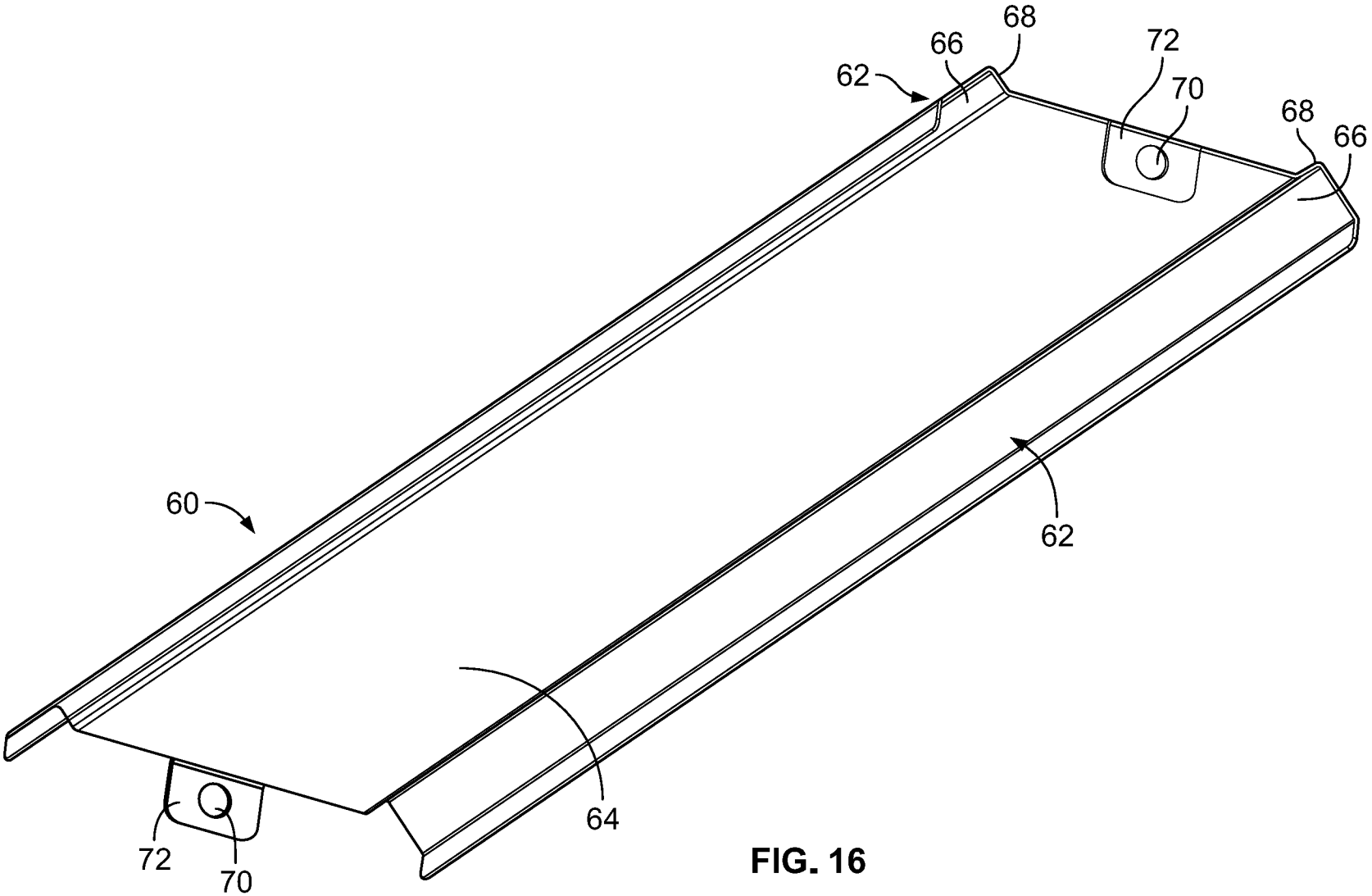
FIG. 16 is a bottom perspective view of the cover of FIG. 11.
Figure 18:
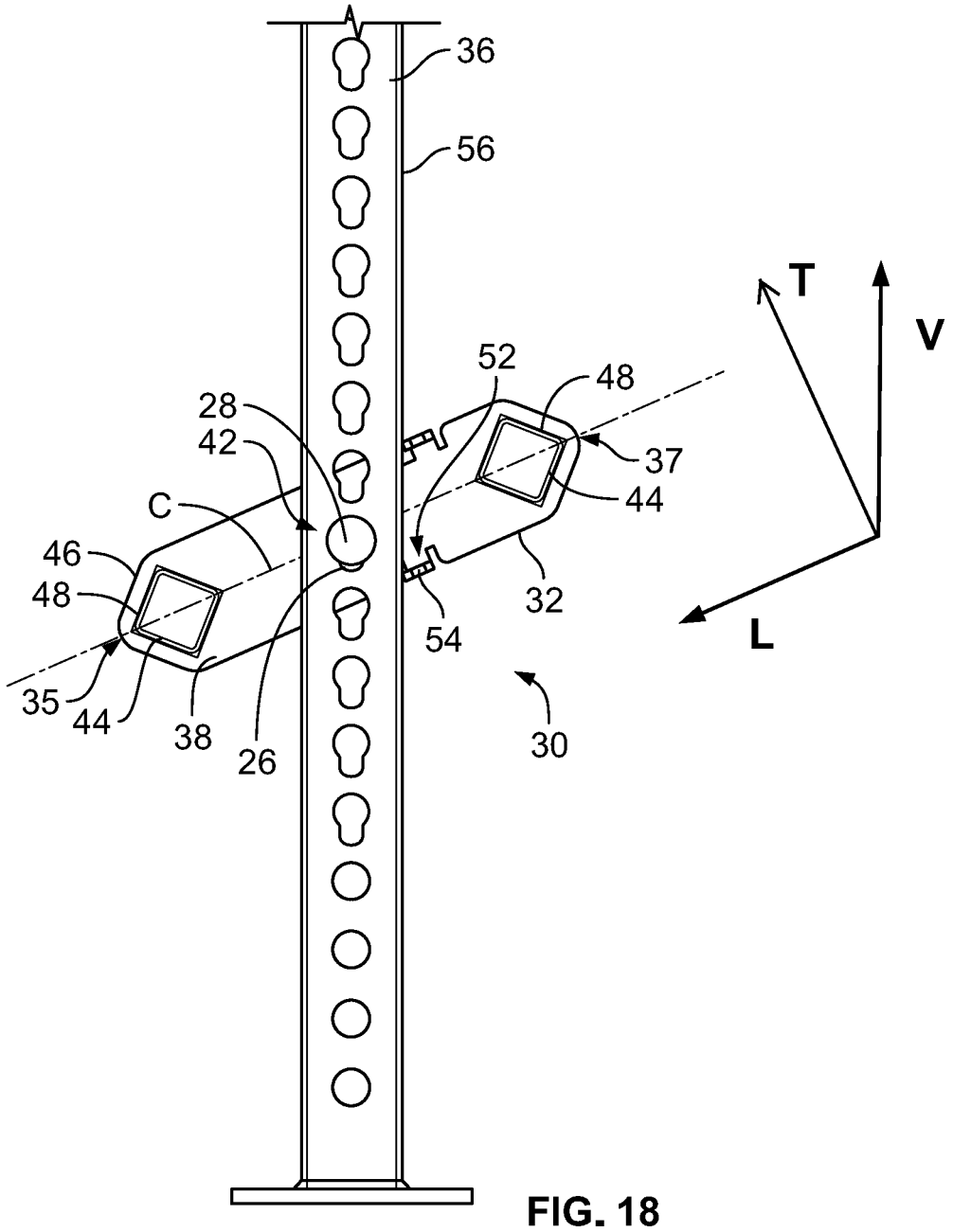
FIG. 18 is a side view of another embodiment of a weight rack according to aspects of the present disclosure.

Each shelf 32 generally has front and rear sides 35, 37 and opposed ends 38, such that the sides 35, 37 extend between the ends 38. In describing the various embodiments herein, the shelf 32 may be oriented with respect to various directions for reference purposes. As shown in FIG. 9, the horizontal direction H is oriented in the direction of elongation of the sides 35, 37 of the shelf 32, and the lateral direction L is oriented in the direction of elongation of the ends 38 of the shelf 32 and perpendicular to the horizontal direction H. A vertical direction V is oriented and defined as being perpendicular to the ground surface upon which the weight rack 30 sits, parallel to the direction of elongation of the support members 36, and transverse to the horizontal and lateral directions H,L. Further, a transverse direction T may be defined as being perpendicular to the horizontal direction H and the lateral direction L. In the embodiment of FIGS. 5-10, the shelf 32 is generally parallel to the surface upon which the weight rack 30 sits, and both the horizontal direction H and the lateral direction L are parallel to this surface. In this configuration, the vertical direction V is perpendicular to both the horizontal and lateral directions H,L, and the transverse direction T and the vertical direction V are the same. In another embodiment, where the shelf 32 is oriented transverse to the surface upon which the weight rack 30 sits, the vertical direction V may not be perpendicular to both the horizontal and lateral directions H,L. For example, for a shelf 32 that angles forward or rearward, the vertical direction V may be perpendicular to the horizontal direction H and perpendicular to the ground, but not perpendicular to the lateral direction L, which is angled with respect to the ground as shown in FIG. 18. In the embodiment of FIG. 18, the transverse direction T is transverse to the vertical direction V.

The weight rack 30 is configured so that each shelf 32 is supported by one or more support members 36, and in one embodiment, the support member(s) 36 may be frame members 20 usable to form a rack assembly 10 as described herein. Each shelf 32 in the weight rack 30 in FIGS. 1-16 is supported by two support members 36, with one support member 36 connected to the shelf 32 at each of two opposed ends 38 of the shelf 32. The support members 36 in FIGS. 1-8 are vertical members oriented to extend vertically. Embodiments of the shelf 32 and the weight rack 30 may permit construction of a weight rack 30 with only a single support member 36 connected at each of the ends 38 of the shelf 32 or shelf stack 34, i.e., with only two total support members 36 supporting each shelf 32 or stack 34, such that the two support members 36 support the entire weight of the shelf 32 (including any objects supported by the shelf 32). Embodiments of the shelf 32 and the weight rack 30 may further permit construction of a weight rack 30 where a single support member 36 can partially support two adjacent shelf stacks 34. Such embodiments can be used to create a weight rack 30 or a rack assembly 10 having one or more weight racks 30 with a number N of adjacent shelves 32 or shelf stacks 34 supported by N+1 vertical members 36. This holds true when the number N of weight racks 30 is one, but also when the number N is greater than 1, up to an infinite number. Existing weight racks 30 typically require 2N+2 vertical members 36 at a minimum to support N adjacent shelves 32 or shelf stacks 34, if not a larger number. This configuration enables significant cost savings due to the reduction in parts and materials necessary to construct the weight rack 30. This configuration also simplifies assembly of the weight rack 30, such as through the assembly method described herein. The structures enabling these configurations are described in greater detail herein, and it is understood that the shelf 32 and the weight rack 30 may be configured so that one or more of the shelves 32 are supported by more than one support member 36 at each end and/or one or more support members 36 at some point(s) between the ends 38 of the shelf 32 in other embodiments.

FIGS. 1-8 depict a rack assembly 10 and weight rack 30 with four shelves 32, including two longer shelves 32 in one stack 34 and two shorter shelves 32 in an adjacent stack 34. The longer and shorter shelves 32 in FIGS. 1-8 have similar structures, and the only significant structural differences between the two types of shelves 32 are the length of the shelves 32 and the fact that the longer shelves 32 each have a cover 60, as described in greater detail elsewhere herein. Notably, the widths (in the lateral direction L) and the heights (in the vertical direction V and/or the transverse direction T) of the longer shelves 32 and the shorter shelves 32 in FIGS. 1-8 are equal. Thus, it is understood that any description of one type of the shorter or longer shelves 32 of FIGS. 1-4 and 7 applies to the other type, unless specified otherwise. FIGS. 5-10 illustrate one of the shorter shelves 32 in greater detail, with the understanding that the longer shelves 32 have similar structures. In one embodiment, the shelf 32 has a shelf body 40 that extends between the ends 38 of the shelf 32, which is configured to support objects on the shelf 32, such as free weights 14, as well as connection structures 42 located at both ends 38 for connection to the support members 36. The shelf body 40 in the embodiment of FIGS. 5-10 is formed by two cross-members 44 that are spaced laterally from each other extend horizontally between the ends 38, and the shelf 32 further has end pieces 46 connected to the cross-members 44 at the ends 38. The end pieces 46 in this embodiment include the connection structures 42. The end pieces 46 are connected to the cross-members 44 as shown in FIGS. 5-10, by receiving the ends of the cross-members 44 in receivers 48 in the end pieces 46. The cross-members 44 may further be welded or otherwise bonded within the receivers 48 in one embodiment. In the embodiment of FIGS. 5-10, the end pieces 46 are metal plates that extend primarily in the lateral and vertical directions, and the receivers 48 are in the form of holes extending completely through the plate-shaped end pieces 46. The cross-members 44 are hollow tubular members that have square or diamond external peripheral shapes and internal peripheral shapes in the embodiment of FIGS. 5-10, and the receivers 48 have similar and complementary square or diamond shapes. The cross-members 44, receivers 48, and end pieces 46 may have numerous different shapes in other embodiments while providing similar functionality. For example, the cross-members 44 and the receivers 48 may have circular, oval or obroud, triangular, hexagonal, or irregular or non-polygonal shapes such as a C-section, an I-section, or a T-section. As another example, the front and rear cross-members 44 may have peripheral shapes that are different from each other and/or the shelf 32 may include a different number, arrangement, and/or spacing of cross-members 44. As a further example, the cross-members 44 also may have a solid body or a tubular body with an internal peripheral shape that is different from the external peripheral shape in other embodiments. It is understood that the receivers 48 may be designed with a shape that is similar and/or complementary to the shape of the cross-members 44 in some embodiments, and that the receivers 48 and cross-members 44 may have similar and/or complementary shapes that are non-circular, such as many of the example shapes described herein.

Figure 6:
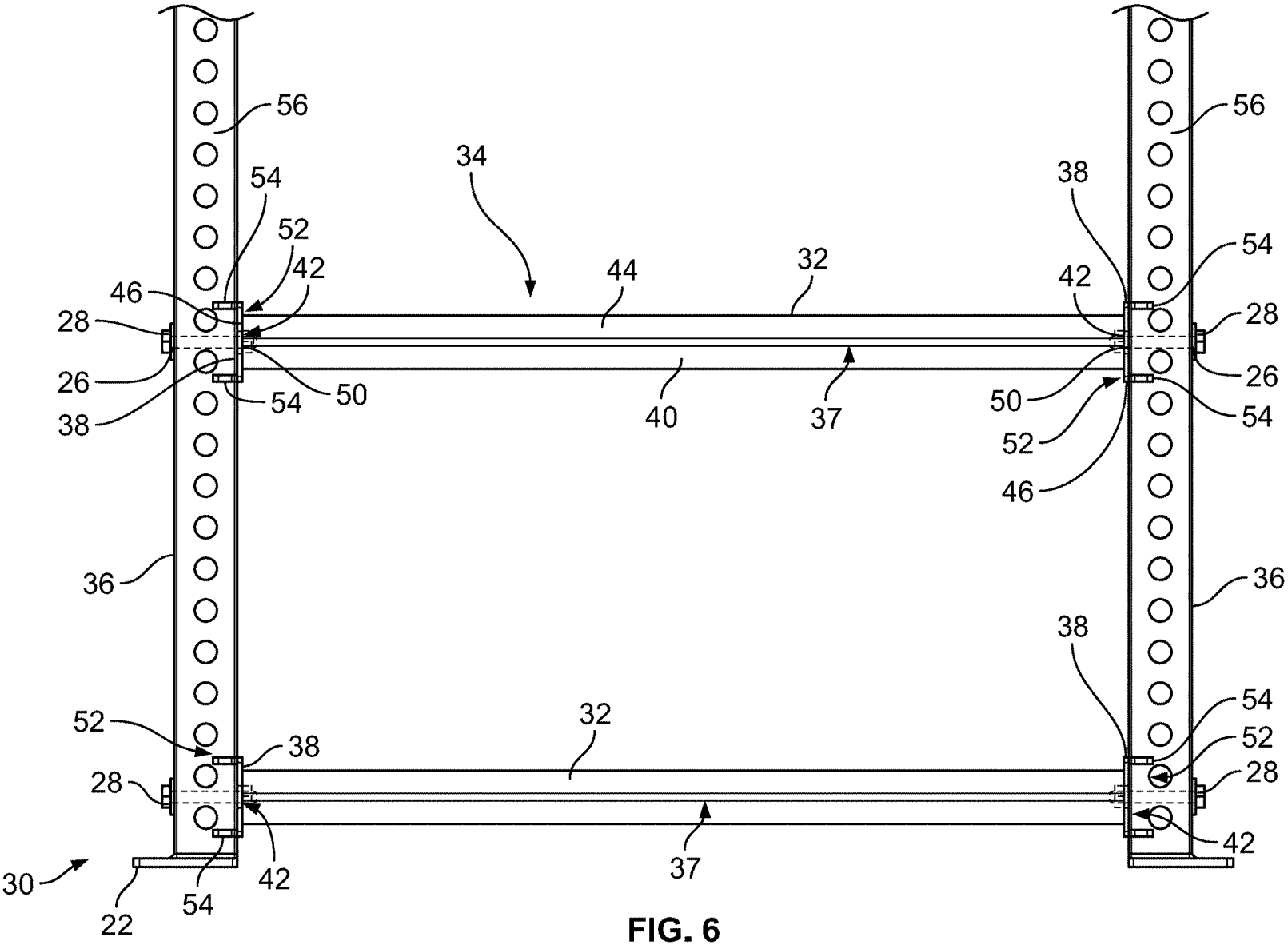
FIG. 6 is a rear view of the weight rack shown in FIG. 3.

The connection structures 42 function to connect the shelf 32 to the support members 36 and are located at the ends 38 of the shelf 32 in one embodiment. In the embodiment of FIGS. 5-10, the connection structures 42 connect the end pieces 46 to the support members 36 by engagement of the end pieces 46. The connection structures 42 in one embodiment are in the form of fastener holes or apertures 50 in the ends 38 of the shelf 32 and fasteners 28 received in the fastener holes 50, and the embodiment of FIGS. 5-10 has fastener holes 50 that extend completely through the end pieces 46. The fasteners 28 in this configuration extend through the fastener holes 26 in the support members 36 and into the fastener holes 50 in the end pieces 46 to support the shelf 32. The embodiment in FIGS. 5-10 uses a single fastener 28 at each end 38 of the shelf 32 to connect the shelf 32 to the support member 36, and the fasteners 28 are illustrated in FIGS. 6-8. In one embodiment, the fasteners 28 may be in the form of pins, including cotter pins or other types of locking pins that have structures to retain the pins in the fastener holes 26, 50. Other types of fasteners 28, including bolts, screws, dowels, etc., may be used in other embodiments, and it is understood that the connection structures 42 may be modified to accept a specific type of fastener 28. As one example, the fastener holes 50, 26 may be keyed to accept a keyed pin or other keyed fastener 28 (e.g., a quarter-turn pin). The fasteners 28 in one embodiment may be inserted through the surfaces of the support members 36 opposite the respective connection structure 42 and extend through the support member 36 and into the connection structure 42. In a configuration where a single support member 36 supports two adjacent shelves 32 on opposite sides thereof, a single fastener 28 may be used to extend completely through the support member 36 via the fastener holes 26 and into the fastener holes 50 in both of the shelves 32 to support two shelves 32 with a single fastener 28, as shown in FIG. 7. In this configuration, a weight rack 30 or a rack assembly 10 having one or more weight racks 30 may have a number N of adjacent shelves 32 or shelf stacks 34 using N+1 fasteners 28 to connect the shelves 32 to the vertical members 36. Alternately, two adjacent shelves 32 could be connected to a single support member 36 with separate fasteners 28. In another embodiment, a different type of connection structure 42 may be used instead of fasteners 28 and holes 50, such as pegs, hooks, tabs, or other structures extending outwardly from the ends 38 of the shelf 32 to engage holes 26 or other structures on the support members 36, or extending inwardly from the support members 36 to engage holes 50 or other structures on the shelf 32.

Figure 17:
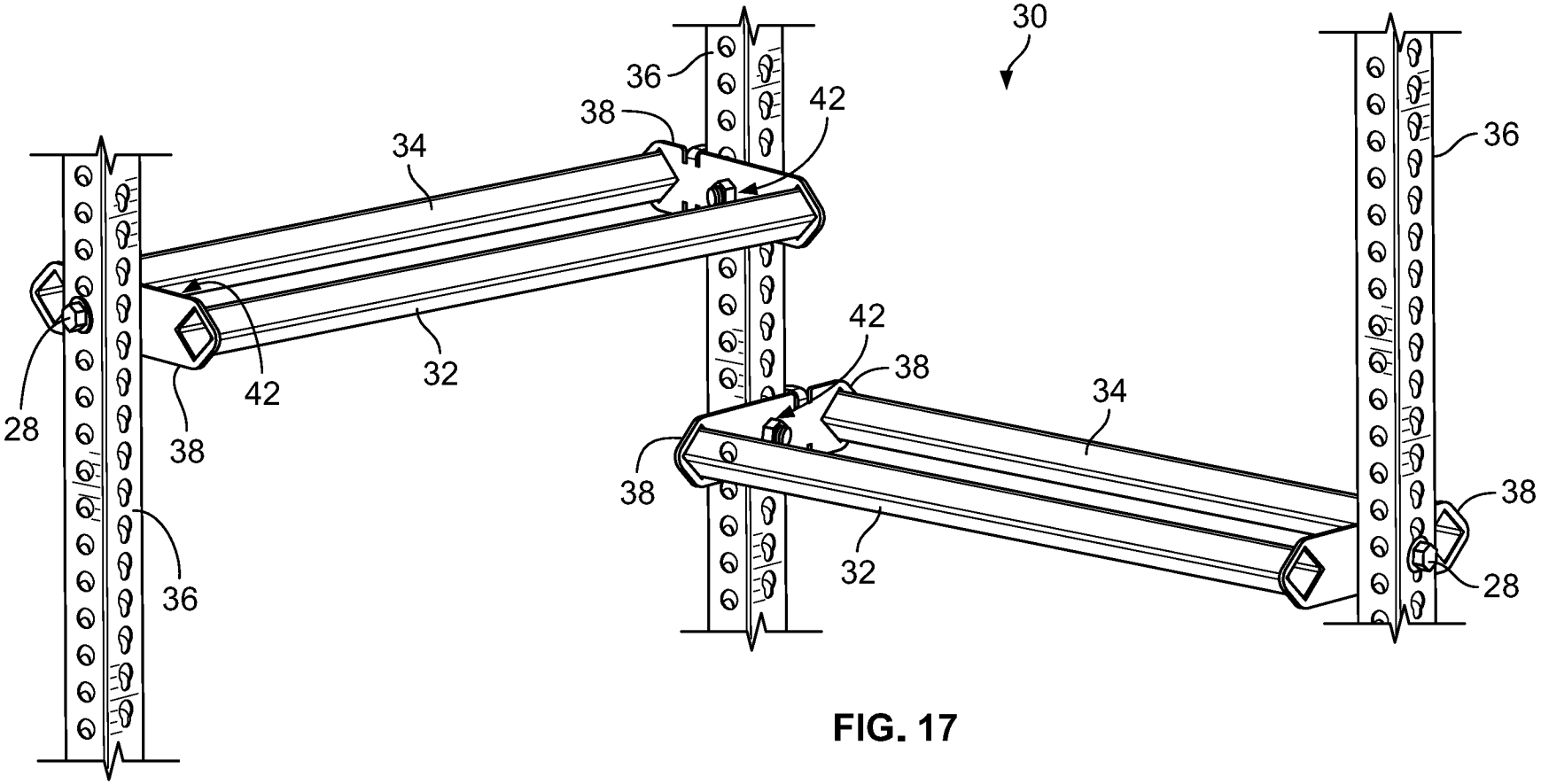
FIG. 17 is a front perspective view of another embodiment of a weight rack according to aspects of the present disclosure.

The configuration of the shelf 32 and the weight rack 30 shown in FIGS. 1-11 and described herein also enables construction of a weight rack 30 having two shelves 32 or shelf stacks 34 arranged at angles to each other, using only a single support member 36 at the "vertex" as shown in FIG. 17. The shelves 32 and the support members 36 in FIG. 17 are otherwise identical to the shelves 32 and support members 36 shown in FIGS. 1-16 and described herein, including all components, features, and variations described herein. The weight rack 30 in FIG. 17 has a single support member 36 with two shelves 32 or shelf stacks 34 connected to the support member 36 at different horizontal angles to each other. This configuration is created by connecting one shelf 32 or shelf stack 34 to a first side of the support member 36 and another shelf 32 or shelf stack 34 to a second side of the support member 36 that is adjacent to the first side (at a 90° angle in FIG. 17). The fasteners 28 of the shelves 32 can connect to the support member 36 at multiple angles due to the configuration of the support member 36 having fastener holes 26 on multiple sides. It is understood that the shelves 32 of one of the stacks 34 may be vertically staggered or offset with respect to the shelves 32 of the other stack 34, in order to provide adequate space. The configuration shown in FIG. 17 enables cost savings through reduction of pieces as described herein, but also enables a great deal of space savings as well. Typical weight racks arranged adjacent to each other at angles must either leave empty space between the ends of the racks or be arranged so that one rack covers some of the shelves of the adjacent rack and renders that shelf space difficult or impossible to access effectively.

In an embodiment where each end 38 of the shelf 32 is connected to the respective support member 36 by a single fastener 28, the shelf 32 may further include additional engaging structure 52 to engage the support member 36 and support the shelf 32. This may be particularly important in usage for a weight rack 30, as weight racks 30 often need to support significant weight, typically hundreds of pounds at least. Such additional engaging structure 52 forms a second point of engagement between the shelf 32 and the support member 36, to enable the use of a single fastener 28 without placing excessive torque on the fastener 28. In one embodiment, the single fasteners 28 at the ends 38 of the shelf 32 support the entire weight of the shelf 32 (including any items on the shelf 32), and the additional engaging structure 52 provides only a rotation stop or rotation-limiting structure. The additional engaging structure 52 may therefore be considered to be a rotation stop or rotation-limiting structure in various embodiments. In this configuration, the forces exerted on the fasteners 28 by the shelf 32 and the support members 36 are vertical in direction, and the forces exerted between the support members 36 and the additional engaging structure is lateral in direction. The shelf 32 in FIGS. 5-10 includes additional engaging structure 52 in the form of a pair of tabs or other projections 54 extending outward from each end 38 of the shelf 32. In the embodiment of FIGS. 5-10, the end pieces 46 are formed of metal plate, and the projections 54 are formed by bending top and bottom peripheral portions of the metal plate at approximately 90° angles to extend outwardly from the end piece 46 and away from the shelf body 40 in the horizontal direction H. The projections 54 in this embodiment may therefore be considered to be part of a single, integral piece with the respective end piece 46. Each pair of projections 54 is located between the connection structure 42 and the rear side 37 of the shelf 32 in the embodiment of FIGS. 5-10, making the projections 54 less visible and less physically intrusive. However, in another embodiment, the projections 54 may be differently oriented. Additionally, the projections 54 of each pair are spaced from each other and located on opposite sides (in the vertical direction V and/or the transverse direction T) of the connection structure 42 that is located on the same end 38 of the shelf 32. More specifically, in one embodiment, the projections 54 on each end 38 are located on opposite sides (in the vertical direction V and/or the transverse direction T) of a line C that extends in the lateral direction L through the center of the connection structure 42 (e.g., through the center of the fastener hole 50) on that same end 38, as shown in FIG. 9. As illustrated in FIGS. 5-8, the projections 54 on each end 38 of the shelf 32 engage the respective support member 36 by abutting the rear surface 56 of the support member 36 above and below the connection structure 42. This engagement between the projections 54 and the support members 36 resists torque and/or rotation of the shelf 32 when imbalanced forces are exerted on the shelf 32, i.e., forces that are not directed through an axis passing through both connection structures 42. As stated elsewhere herein, the projections 54 in this embodiment function primarily or solely to resist torque and/or rotation of the shelf 32, and the connection structures 42 (e.g., fasteners 28 and holes 50) support the entire weight of the shelf 32.

In other embodiments, each end 38 of the shelf 32 may have a single projection 54, or one end 38 of the shelf 32 may have two projections 54, and the other end 38 of the shelf 32 may have none. The additional engaging structure 52 may be structured to limit rotation of the shelf 32 in another manner, and may include a different structure that engages both the shelf 32 and one or more vertical support member(s) 36 to limit such rotation. For example, in FIGS. 5-10, the additional engaging structure 52 is connected to the shelf 32 and engages the vertical members 36 by abutment, and in another embodiment, the additional engaging structure 52 may be transposed to be connected to one or more of the vertical members 36 and engaging the shelf 32 by abutment.

FIG. 18 illustrates an embodiment of a rack assembly 30 with a shelf 32 configured to be positioned at an incline to the ground or other surface upon which the rack assembly 30 sits. The shelf 32 (including the lateral direction L thereof) is also not perpendicular to the vertical direction V in FIG. 18, and the vertical direction V is transverse to the transverse direction T in this embodiment. The overall structure of the shelf 32 in FIG. 18, including the connection structure 42, is similar or identical to the corresponding structure in FIGS. 1-10, and such structure may not be described again in detail with respect to FIG. 18 for the sake of brevity. Any components, features, and variations described herein may be incorporated into the embodiment of FIG. 18. The additional engaging structure 52 in FIG. 18 is similar to the additional engaging structure 52 shown in FIGS. 5-10 and described herein, and is modified for use with an angled shelf 32. This additional engaging structure 52 includes a pair of projections 54 that are located between the connection structure 42 and the rear side 37 of the shelf 32. The projections 54 of each pair are also spaced from each other and located on opposite vertical sides of the connection structure 42 that is located on the same end 38 of the shelf 32. More specifically, in the embodiment illustrated in FIG. 18, the projections 54 on each end 38 of the shelf 32 are located on opposite vertical sides of a line C that extends in the lateral direction L through the center of the connection structure 42 (e.g., through the center of the fastener hole 50) on that same end 38. The projections 54 in this embodiment are also spaced in the transverse direction T and are aligned with the vertical direction V. It is understood that the additional engaging structure 52, or other structures of the shelf 32, may be further modified to adapt to additional angles of orientation. It is also understood that a cover 60 as described herein may be used in connection with the shelf 32 in FIG. 18.

Some of the shelves 32 in FIGS. 1-4 include a cover 60 that covers at least a portion of a top side of the shelf 32. FIGS. 11-16 illustrate the cover 60 and the engagement between the cover 60 and the shelf 32 in greater detail. As shown in FIGS. 11-16, the cover 60 engages and is supported by both of the cross-members 44 and extends between the cross-members 44. The cover 60 in this embodiment includes two engagement portions 62 engaging the two cross-members and a span 64 extending between the engagement portions 62. In a configuration such as shown in FIGS. 11-16, where a space 65 is defined between the cross-members 44, the span 64 extends across the space 65 between the cross-members 44. The engagement portions 62 may include bends, contours, or other structural features for engaging the cross-members 44 in one embodiment. The engagement portions 62 in FIGS. 11-16 each include an elongated, recessed channel 66 defined in the bottom surface of the cover 60, which are created by linear bends in the cover 60. The cross-members 44 are at least partially received within the channels 66, and the cover 60 covers at least the top sides and outermost sides of the cross-members 44 (i.e., the front side of the front cross-member 44 and the rear side of the rear cross-member 44). The channels 66 may be dimensioned and configured to engage the cross-members 44, such as by having a shape that is complementary with the shape of the cross-members 44. For example, the channels 66 in FIGS. 11-16 have an angular shape to correspond to the square or diamond shape of the cross-members 44. It is understood that the channels 66 may be configured differently if a cross-member 44 with a different configuration is used. The channels 66 also create raised portions 68 on the top surface of the cover 60. In other embodiments, the engagement portions 62 may take a different form, such as a hook, clamp, or other mechanical engaging structure. The cover 60 in FIGS. 11-16 further includes fastener holes 70 that are aligned with the fastener holes 50 of the shelf 32 to permit the fasteners 28 to extend through both the fastener holes 50, 70 to further secure the cover 60 to the shelf 32. The fastener holes 70 in the embodiment of FIGS. 11-16 are provided on flanges 72 depending from the underside of the cover 60, which extend downward on the inner surfaces of the end plates 46.

The cover 60 in FIGS. 11-16 adds to the versatility of the shelf 32 by providing different functionality. As shown in FIGS. 1-2, the shelf 32 without the cover 60 is particularly suitable for holding circular weight plates 14, as well as medicine balls and other similarly-dimensioned articles, which are supported by the cross-members 44. The configuration of the cover 60 configured as shown in FIGS. 11-16 is particularly suitable for holding dumbbells, kettlebells (not shown), and other similarly-dimensioned articles, including articles having sizes that are smaller than the space between the cross-members 44, due to the additional support provided by the span 64. The raised portions 68 may also assist in holding dumbbells or other items in place. Other covers 60 may have different configurations for providing further functionality. It is understood that the shelf 32 itself may not have a space 65 and may instead provide a support surface, and in this configuration, the span 64 of the cover 60 may cover and confront such a support surface. For example, the top side of the shelf 32 may resemble the general shape and contour of the shelf 32 with the cover 60 as shown in FIGS. 11-14.

The design of the shelf 32 also facilitates assembly of the weight rack 30. The shelf 32 can be mounted on the support members 36 by positioning the support members 36 at the proper distance apart and then sliding the shelf 32 between the support members 36 with the front side 35 leading, i.e., in the direction of the arrows A in FIGS. 7-8. The connection structure 42 can then be engaged with the support members 36, such as by insertion of the fasteners 28 through the fastener holes 26, 50 in the embodiment of FIGS. 5-10 to complete connection of the shelf 32 and create the weight rack 30. No welding or additional connection techniques are necessary. Additional shelves 32 may be installed above or below the first shelf 32, thereby increasing the number of shelves 32 in the shelf stack 34. This simple installation method is particularly useful for installing a shelf 32 on a weight rack 30 or rack assembly 10 with a frame 12 that has already been assembled, or for replacing one shelf 32 with another shelf 32. It is understood that removal of a shelf 32 may be accomplished using the opposite sequence of actions, i.e., by disconnecting the connection structure 42 and removing the shelf 32 in the opposite direction of arrows A. If the shelf 32 is to be installed using a cover 60 as shown in FIGS. 11-16, the cover 60 is placed on top of the shelf 32 prior to installation, so that the cross-members 44 are received in the channels 66 and the fastener holes 70 are aligned with the fastener holes 50 of the shelf 32. The fasteners 28 are then inserted through both the fastener holes 50, 70 to secure the cover 60 and the shelf 32 in place. It is also understood that the assembly method for the weight rack 30 may differ based on features of the shelf 32.

The various embodiments of shelves, shelf covers, and weight racks including the same as described herein provide benefits and advantages over existing shelves, covers, and weight racks, including existing shelves and weight racks that are configured to be mounted with four vertical support members connected to each shelf. For example, the configuration of the shelves permits the construction of a weight rack with storage shelves using a minimal number of vertical support members, which reduces material usage and cost of the weight rack, and may also reduce the footprint of the weight rack. The shelves require insertion of fewer fasteners as compared to existing shelves, and assembly is thereby simplified. This configuration also permits a weight rack to maximize the use of space in corners. The configuration of the covers similarly requires minimal necessary structure and simplifies assembly. In fact, the covers can be securely installed without requiring any additional structural or connection components that are not already required for mounting of the shelf itself. Still further benefits and advantages are recognizable to those skilled in the art.

Various embodiments of shelves, shelf covers, and weight racks including the same have been described herein, which include various components and features. In other embodiments, the shelves, shelf covers, and weight racks may be provided with any combination of such components and features. It is also understood that in other embodiments, the various devices, components, and features of the shelves, shelf covers, and weight racks described herein may be constructed with similar structural and functional elements having different configurations, including different ornamental appearances.

Several alternative embodiments and examples have been described and illustrated herein. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the spirit or central characteristics thereof. The present examples and embodiments, therefore, are to be considered in all respects as illustrative and not restrictive, and the invention is not to be limited to the details given herein. The terms "top," "bottom," "front," "back," "side," "rear," "proximal," "distal," and the like, as used herein, are intended for illustrative purposes only and do not limit the embodiments in any way. Nothing in this specification should be construed as requiring a specific three dimensional orientation of structures in order to fall within the scope of this invention, unless explicitly specified by the claims. "Integral joining technique," as used herein, means a technique for joining two pieces so that the two pieces effectively become a single, integral piece, including, but not limited to, irreversible joining techniques such as welding, brazing, soldering, or the like, where separation of the joined pieces cannot be accomplished without structural damage thereto. Additionally, the term "plurality," as used herein, indicates any number greater than one, either disjunctively or conjunctively, as necessary, up to an infinite number. When used in description of a method or process, the term "providing" as used herein means generally making an article available for further actions, and does not imply that the entity "providing" the article manufactured, assembled, or otherwise produced the article. Accordingly, while the specific embodiments have been illustrated and described, numerous modifications come to mind without significantly departing from the spirit of the invention and the scope of protection is only limited by the scope of the accompanying claims.

What is claimed is:

1. A weight rack comprising:

a first vertical member and a second vertical member extending generally parallel to each other and positioned in spaced relation to each other;

a shelf configured to support one or more free weights and having first and second opposed ends and front and rear sides extending between the first and second ends, wherein the first end of the shelf is connected to the first vertical member and the second end of the shelf is connected to the second vertical member, such that the first vertical member and the second vertical member support an entire weight of the shelf, wherein the first end of the shelf has a first connection structure and a first pair of projections, wherein the first pair of projections are positioned between the first connection structure and the rear side of the shelf, and wherein the first pair of projections are spaced from each other and located on opposite vertical sides of the first connection structure, and the second end of the shelf has a second connection structure and a second pair of projections, wherein the second pair of projections are positioned between the second connection structure and the rear side of the shelf, and wherein the second pair of projections are spaced from each other and located on opposite vertical sides of the second connection structure;

a first fastener connecting the first connection structure to the first vertical member; and a second fastener connecting the second connection structure to the second vertical member, wherein the first pair of projections are configured to engage the first vertical member to limit rotation of the shelf with respect to the first vertical member, and the second pair of projections are configured to engage the second vertical member to limit rotation of the shelf with respect to the second vertical member.

2. The weight rack of claim 1, wherein the first and second vertical members each have a fastener hole, and wherein the first and second fasteners each comprise a bolt or pin extending through the fastener holes of the first and second vertical members and engaging the first and second connection structures of the shelf to connect the shelf to the first and second vertical members.

3. The weight rack of claim 1, further comprising a cover covering at least a portion of a top surface of the shelf and configured to support the one or more free weights, wherein the cover comprises a first flange and a second flange depending from opposed ends of the cover, wherein the first flange is positioned such that the first fastener engages the first vertical member, the first connection structure, and the first flange to connect the cover to the shelf and the first vertical member, and the second flange is positioned such that the second fastener engages the second vertical member, the second connection structure, and the second flange to connect the cover to the shelf and the second vertical member.

4. The weight rack of claim 1, wherein the shelf comprises a cross-member configured to support the one or more free weights, a first end piece connected to the cross-member at the first end, and a second end piece connected to the cross-member at the second end, wherein the first pair of projections extend outwardly from the first end piece, and the second pair of projections extend outwardly from the second end piece.

5. The weight rack of claim 4, wherein the first end piece and the second end piece each comprise a receiver, and wherein the cross-member is received within the receivers on the first and second end pieces to connect the first and second end pieces to the cross-member.

6. The weight rack of claim 4, wherein the shelf further comprises a second cross-member spaced from the cross-member and configured to support the one or more free weights in combination with the cross-member, wherein the second cross member is connected to the first end piece at the first end and is connected to the second end piece at the second end.

7. The weight rack of claim 6, wherein the first end piece and the second end piece each comprise a first receiver and a second receiver, wherein the cross-member is received within the first receivers on the first and second end pieces to connect the first and second end pieces to the cross-member, and wherein the second cross-member is received within the second receivers on the first and second end pieces to connect the first and second end pieces to the second cross-member.

8. The weight rack of claim 6, further comprising a cover covering at least a portion of a top side of the shelf and configured to support the one or more free weights, wherein the cover comprises a first engagement portion engaging the cross-member, a second engagement portion engaging the second cross-member, and a span extending between the first and second engagement portions, such that the span extends across a space between the cross-member and the second cross-member.

9. The weight rack of claim 8, wherein the first engagement portion and the second engagement portion each comprise an elongated, recessed channel defined in a bottom surface of the cover, such that the cross-member and the second cross-member are at least partially received within the channels of the first and second engagement portions, respectively.

10. The weight rack of claim 1, further comprising:

a second shelf configured to support one or more additional free weights and spaced vertically from the shelf, the second shelf having first and second opposed ends and front and rear sides extending between the first and second ends, wherein the first end of the second shelf is connected to the first vertical member and the second end of the second shelf is connected to the second vertical member, such that the first vertical member and the second vertical member support an entire weight of the second shelf, wherein the first end of the second shelf has a first connection structure and a first pair of projections, wherein the first pair of projections are positioned between the first connection structure and the rear side of the second shelf, and wherein the first pair of projections are spaced from each other and located on opposite vertical sides of the first connection structure, and the second end of the second shelf has a second connection structure and a second pair of projections, wherein the second pair of projections are positioned between the second connection structure and the rear side of the second shelf, and wherein the second pair of projections are spaced from each other and located on opposite vertical sides of the second connection structure;

a third fastener connecting the first connection structure of the second shelf to the first vertical member; and a fourth fastener connecting the second connection structure of the second shelf to the second vertical member.

11. The weight rack of claim 1, wherein the first pair of projections engage the first vertical member by abutment, and the second pair of projections engage the second vertical member by abutment.

12. The weight rack of claim 1, further comprising a number of vertical members including the first vertical member and the second vertical member and a number of adjacent shelf stacks including the shelf that are supported by the vertical members, wherein the number of shelf stacks is N and the number of vertical members is N+1.

13. A weight rack comprising:

a first vertical member and a second vertical member extending generally parallel to each other and positioned in spaced relation to each other; and a shelf configured to support one or more free weights and having first and second opposed ends and front and rear sides extending between the first and second ends, wherein the shelf comprises a cross-member configured to support the one or more free weights, a first end piece connected to the cross-member at the first end, and a second end piece connected to the cross-member at the second end, wherein the first end piece and the second end piece each comprise a receiver, and wherein the cross-member is received within the receivers on the first and second end pieces to connect the first and second end pieces to the cross-member, and wherein the first end piece of the shelf is connected to the first vertical member and the second end piece of the shelf is connected to the second vertical member, such that the first vertical member and the second vertical member support an entire weight of the shelf; and a rotation limiting structure engaging the shelf and at least one of the first and second vertical members and configured to limit rotation of the shelf with respect to the first and second vertical members, wherein the rotation limiting structure comprises a first pair of projections connected to the first end of the shelf at different vertical locations and configured to abuttingly engage the first vertical member to limit rotation of the shelf with respect to the first and second vertical members, and a second pair of projections connected to the second end of the shelf at different vertical locations and configured to abuttingly engage the second vertical member to limit rotation of the shelf with respect to the first and second vertical members, wherein the first pair of projections extend outwardly from the first end piece, and the second pair of projections extend outwardly from the second end piece.

14. The weight rack of claim 13, wherein the shelf further comprises a second cross-member spaced from the cross-member and configured to support the one or more free weights in combination with the cross-member, wherein the second cross member is connected to the first end piece at the first end and is connected to the second end piece at the second end.

15. The weight rack of claim 14, wherein the first end piece and the second end piece each comprise a first receiver and a second receiver, wherein the cross-member is received within the first receivers on the first and second end pieces to connect the first and second end pieces to the cross-member, and wherein the second cross-member is received within the second receivers on the first and second end pieces to connect the first and second end pieces to the second cross-member.

16. The weight rack of claim 13, wherein the first and second vertical members each have a fastener hole, and wherein the weight rack further comprises first and second fasteners extending through the fastener holes of the first and second vertical members and engaging the first and second ends of the shelf to connect the shelf to the first and second vertical members, respectively.

17. The weight rack of claim 13, further comprising a number of vertical members including the first vertical member and the second vertical member and a number of adjacent shelf stacks including the shelf that are supported by the vertical members, wherein the number of shelf stacks is N and the number of vertical members is N+1.

18. A weight rack comprising:

a first vertical member and a second vertical member extending generally parallel to each other and positioned in spaced relation to each other; and a shelf configured to support one or more free weights and having first and second opposed ends and front and rear sides extending between the first and second ends, wherein the first end of the shelf is connected to the first vertical member and the second end of the shelf is connected to the second vertical member, such that the first vertical member and the second vertical member support an entire weight of the shelf, wherein the shelf comprises a cross-member configured to support the one or more free weights, a first end piece connected to the cross-member at the first end, and a second end piece connected to the cross-member at the second end, and wherein the shelf further comprises a second cross-member spaced from the cross-member and configured to support the one or more free weights in combination with the cross-member, wherein the second cross member is connected to the first end piece at the first end and is connected to the second end piece at the second end;

a rotation limiting structure engaging the shelf and at least one of the first and second vertical members and configured to limit rotation of the shelf with respect to the first and second vertical members, wherein the rotation limiting structure comprises a first pair of projections connected to the first end of the shelf at different vertical locations and configured to abuttingly engage the first vertical member to limit rotation of the shelf with respect to the first and second vertical members, and wherein the rotation limiting structure further comprises a second pair of projections connected to the second end of the shelf at different vertical locations and configured to abuttingly engage the second vertical member to limit rotation of the shelf with respect to the first and second vertical members, wherein the first pair of projections extend outwardly from the first end piece, and the second pair of projections extend outwardly from the second end piece; and a cover covering at least a portion of a top side of the shelf and configured to support the one or more free weights, wherein the cover comprises first and second elongated, recessed channels defined in a bottom surface of the cover, and a span extending between the first and second channels, wherein the cross-member and the second cross-member are at least partially received within the first and second channels, respectively, such that the span extends across a space between the cross-member and the second cross-member.

19. A weight rack comprising:

a first vertical member and a second vertical member extending generally parallel to each other and positioned in spaced relation to each other; and a shelf configured to support one or more free weights and having first and second opposed ends and front and rear sides extending between the first and second ends, wherein the first end of the shelf is connected to the first vertical member and the second end of the shelf is connected to the second vertical member, such that the first vertical member and the second vertical member support an entire weight of the shelf, a rotation limiting structure engaging the shelf and at least one of the first and second vertical members and configured to limit rotation of the shelf with respect to the first and second vertical members; and a cover covering at least a portion of a top surface of the shelf and configured to support the one or more free weights, wherein the cover comprises a first flange and a second flange depending from opposed ends of the cover, wherein the first flange is positioned such that a first fastener engages the first vertical member, the first end of the shelf, and the first flange to connect the cover to the shelf and the first vertical member, and the second flange is positioned such that a second fastener engages the second vertical member, the second end of the shelf, and the second flange to connect the cover to the shelf and the second vertical member.

20. A weight rack comprising:

a first vertical member and a second vertical member extending generally parallel to each other and positioned in spaced relation to each other; and a shelf configured to support one or more free weights and having first and second opposed ends and front and rear sides extending between the first and second ends, wherein the first end of the shelf is connected to the first vertical member and the second end of the shelf is connected to the second vertical member, such that the first vertical member and the second vertical member support an entire weight of the shelf, wherein the first end of the shelf has a first connection structure and a first projection, wherein the first projection is positioned between the first connection structure and the rear side of the shelf, and the second end of the shelf has a second connection structure and a second projection, wherein the second projection is positioned between the second connection structure and the rear side of the shelf, a first fastener connecting the first connection structure to the first vertical member; and a second fastener connecting the second connection structure to the second vertical member, wherein the first projection is configured to abuttingly engage the first vertical member to limit rotation of the shelf with respect to the first vertical member, and the second projection is configured to engage the second vertical member to limit rotation of the shelf with respect to the second vertical member.

21. The weight rack of claim 20, wherein the first projection is offset vertically from the first connection structure, and the second projection is offset vertically from the second connection structure.

22. The weight rack of claim 20, wherein the first projection abuttingly engages a rear surface of the first vertical member, and the second projection abuttingly engages a rear surface of the second vertical member.

* * * * *